US005282716A

United States Patent [19]

Prim et al.

[11] Patent Number: 5,282,716

[45] Date of Patent: Feb. 1, 1994

[54] METHOD AND APPARATUS FOR STACKING, ALIGNING AND COMPRESSING SIGNATURES

[75] Inventors: John Prim, W. Chazy; David Hall, Plattsburgh, both of N.Y.

[73] Assignee: Quipp Systems, Inc., Miami, Fla.

[21] Appl. No.: 734,187

[22] Filed: Jul. 22, 1991

Related U.S. Application Data

[62] Division of Ser. No. 534,451, Jun. 6, 1990, Pat. No. 5,092,236.

[51] Int. Cl.[5] ..... B65G 57/06

[52] U.S. Cl. ..... 414/790.3; 414/786; 414/789.1; 414/790.8; 414/791.2; 414/900; 414/907

[58] Field of Search ..... 100/220; 271/213, 214, 271/217, 220; 414/788.3, 790.8, 907, 790.3, 791.2, 786, 789.1, 900; 53/528, 529

[56] References Cited

U.S. PATENT DOCUMENTS 4,229,134 10/1980 Reist ..... 198/747 X
4,708,561 11/1987 Merkli et al. ..... 414/790.3 X
4,886,265 12/1989 Wetter ..... 414/791.2 X

FOREIGN PATENT DOCUMENTS 60-15352 1/1985 Japan ..... 414/790.3
243764 10/1986 Japan ..... 414/791.2

*Primary Examiner*—Michael S. Huppert
*Assistant Examiner*—Janice Krizek
*Attorney, Agent, or Firm*—Louis Weinstein

[57] ABSTRACT

A stack of signatures are dropped upon the platform halves of a rotatable platform, the platform halves being raised to reduce the free fall distance from the point where the stack of signatures are dropped and a lower stack ejection position. The platform halves are lowered as each stack of signatures is delivered thereto. Eventually, the platform is lowered to the stack ejection position and the pusher is pushed through a gap provided between the platform halves to eject a completed bundle from the platform. The pusher moves through the gap as the platform is being raised or lowered to significantly reduce the cycle time. Stack compressors are selectively movable to a position above the turntable and by selectively raising the platform halves, the accumulated stack of signatures on the platform halves are squeezed between the compression members and the platform halves to form a neat, compressed bundle. The turntable is rotatable through a half-revolution to form compensated stacks. The pusher may be returned to a start position while the platform halves are being raised without fear of collision due to the provision of the gap between the platform halves.

31 Claims, 19 Drawing Sheets

METHOD AND APPARATUS FOR STACKING, ALIGNING AND COMPRESSING SIGNATURES

This is a division of application Ser. No. 534,451, filed Jun. 6, 1990, now abandoned.

FIELD OF THE INVENTION

The present invention relates to signature stackers and more particularly to a novel signature stacker for forming signature bundles and particularly highly compressed compensated signature bundles in which the signatures are aligned to an extremely tight tolerance and to a novel stacker and compression and bundle pusher method and apparatus.

BACKGROUND OF THE INVENTION

One of the typical, but nevertheless important objectives in signature stacking is to produce signature bundles in which the signatures are aligned to a high degree of precision and in which the bundle is compressed sufficiently to remove as much air from between and among the signatures as is possible and to compress the folded signatures to form a bundle in which the top and bottom surfaces are as near to parallel as is practicable. For example, signatures of a tabloid form having a folded edge typically have a thickness adjacent the folded edge which is greater than the thickness adjacent the opposite parallel cut edge. The cumulative effect of this difference in thickness results in the formation of a bundle in which one side edge is significantly taller than the opposite side edge yielding an awkward bundle which is difficult to wrap and handle.

The standard technique utilized to correct the aforementioned problem typically consists of forming compensated bundles in which signature stacks which are typically of the same count are oriented at 180° relative to the adjacent stack which substantially evenly distributes the folded edges by arranging them along opposite sides of the bundle. This is accomplished by depositing a stack of signatures upon a turntable in which the folded edges are all aligned on one side of the stack. The turntable is then rotated through 180° preparatory to receiving the next stack of signatures, whereby the folded edges of the two stacks are arranged on opposite sides of the multi-stack bundle, thereby forming a compensated bundle.

The techniques presently employed to compress signatures to reduce the thickness of the folded edges comprise passing a stream of signatures being delivered to the stacker between squeeze rolls and/or compressing a stack of signatures between upper and lower compression members when the signatures reach a stacking bin.

Equipment is presently available which enables the delivery of signatures to the stacking equipment at significantly increased delivery rates thereby necessitating the need for high speed stacking equipment capable of operating at speeds commensurate with the delivery speeds of present day equipment.

Present day techniques for stack compression include the provision of either motor driven or hydraulically driven compression members which are normally retracted from the stacking region and are extended to a position above the last delivered stack. The platform supporting the stack of signatures is then raised to compress the stack between the compression members and the platform. The platform is then lowered, the compression members are then removed from the stacking region and the next stack is delivered to the stacking region, the compression members are returned to a position in the stacking region above the stack and the compression operation is again performed however, on both stacks deposited on the platform. This technique is repeated depending upon the number of stacks desired per bundle. The compression technique may be used alone or together with the compensation technique.

Conventional equipment requires the use of motor or hydraulic drives as well as control equipment to operate the compression members. In addition, in order to assure proper alignment of the signature bundle, it is typical to eliminate a final compression operation upon completion of the bundle since compression on bundle completion requires that the compression members be located at a distance above the platform sufficient to stack a fully completed bundle beneath the compression members and further due to the need to reduce cycle time in order to accommodate high speed signature delivery equipment.

BRIEF DESCRIPTION OF THE INVENTION

In order to significantly reduce the cycle time for the stacker, the present invention causes a subsequent signature stack to be dropped upon the compression members while the last-received signature stack (or stacks) are still undergoing compression. It is thus necessary to provide supports extending upwardly a distance sufficient to fully support and align the signature stack resting upon the compression members.

The present invention provides compression apparatus and a method which overcomes the disadvantages of present day systems and further eliminates the need for motor or hydraulic drive and the controls and sensors which must necessarily be provided in present day systems to operate the drive means, the present invention providing pivotally mounted freely swingable compression clips arranged along the supports of a stacking bin which, due to their unique design, normally maintain the clip arms in the extended position while allowing the clip arms to freely swing out of the path of movement of a signature stack simply due to the force of the dropping stack, and which thereafter return to their normal, extended position, totally eliminating the need for drive means, sensors or controls for the compression clips. The clips also serve to support the next completed stack during the time that the previous stack is being compressed.

The clips automatically move out of the path of the stack when the stack drops below the clips enabling the stack supported thereon to be collected upon a platform for receiving and supporting signature stacks in the stacking bin which platform is again raised for compressing the stacks accumulated thereon between the platform and the compression clips. This technique is repeated for each successive stack.

The compression clips are positioned a spaced distance below the top of the lower bin supports which typically prevents final compression upon completion of the stack. To provide for final compression of the complete stack the present invention utilizes an upper set of compression clips which are located near the top end of the lower bin supports. The upper clips are substantially identical to the first-mentioned compression clips in both design and function. However, when a final stack is delivered to the lower bin platform such that the distance between the lower clips and the bottom position of the platform is less than the height of the stack, the upper clips permit a final compression operation. The lower set of compression clips continue to perform the function of compressing the signature stacks of either a completed or incompleted bundle, the height of which is less than the distance between the bottom position of the platform and the lower compression clips, the lower compression clips further enabling receipt of a subsequent (i.e. "final") signature stack supported upon the lower compression clips during a compression operation, the lower bin supports maintaining the just delivered signature stack in proper alignment until the signature stack supported upon the lower set of compression clips is lowered sufficiently to move the lower set of compression clips out of the way of the stack just supported thereon so that it may rest upon the previously completed stack.

Electromagnetic holding means may be provided to retain the lower set of compression clips in the retracted state during the time that the upper compression clips are utilized for final compression of the completed stack.

The stacker of the present invention utilizing the above techniques is comprised of an infeed section which is articulated to enable its inlet end to be aligned with a variety of different delivery conveyors having a height over the range of from 14 to 40 inches above the supporting floor. Diverter means are provided to divert the stream away from the stacker in the event of a jam or other potential problem to prevent the stacker from being damaged. Stream aligning belt means realigns any skewed signatures in the stream. The signatures then pass through hydraulically-operated squeeze rolls which serve to squeeze air captured between the pages of the signatures as well as between signatures and to compress the signatures and especially the folded ends thereof. Signatures then enter into a counting region where they are counted by non-contact sensor means such as an infrared sensor as they are driven beneath the sensor by belt means. The signatures also pass beneath a gapper assembly which is in an upper position which unblocks the flow of signatures enabling the signatures to be collected within an upper bin having a floor defined by: a pair of reciprocating plates; upstream and downstream sidewalls having belt assemblies continuously moving to drive the signatures downwardly toward the floor of the upper bin; and at least one lateral sidewall spanning the region between the upstream and downstream walls; certain of said sidewalls being provided with joggers for jogging and hence aligning the signatures as they are being collected in the upper bin.

When the desired number of signatures are delivered to the upper bin, the counting means causes the gapper to move to the blocking state for temporarily blocking the delivery of signatures beyond the desired count to the upper bin. The signatures downstream of the gapper continue to be fed into the upper bin by feed belts, to complete the stack.

A plurality of tubes are arranged with their outlet ends positioned above the upper bin. Compressed air is delivered to the top of the stack through these tubes to further aid in the formation of a neat, compressed stack.

The height of the upper bin is adjustable to any one of a plurality of positions by vertical adjustment of the reciprocating floor plates employed by the upper bin to accommodate signature products of greater thickness, i.e. a larger number of pages. For example, a first upper bin depth is typically provided for storing signatures which are twelve pages or less, a second greater depth is utilized for collecting signatures of twelve to twenty-four pages, and a maximum depth is selected when collecting signatures having from twenty-four to ninety-six pages.

The lower bin which receives signature stacks from the upper bin is located beneath the upper bin and is comprised of a rotatably mounted turntable having a platform capable of being lowered or raised. Supports are provided along opposite parallel sides of the platform for receiving and guiding the signatures delivered from the upper bin and for maintaining the signatures in proper alignment. Gates are swingably mounted along the opposite ends of each of the supports. The gates are moved to a closed position engaging the sides of the signatures adjacent the sides engaged by the supports, and an opened position which enables the pusher to push a completed bundle off of the platform and onto a take-off conveyor. The lower bin is rotatably mounted and is rotated under control of a cylinder for the purpose of forming compensated bundles, the swingable gates being held in the closed position to maintain the alignment of the signature stack during rotation.

The upper and lower bins are adjustable in both their length and width to accommodate signatures of varying lengths and widths typically over a range of from 5 to 20 inches width and from 5 ¼ to 12 ¾ inches length.

Cylinders are provided to raise and lower the turntable, which is of a split design to enable the passage of a cylinder-driven pusher, the gap provided in the split turntable enabling the pusher to pass through the turntable as it is being raised or lowered to facilitate prepositioning of the pusher during the time that the turntable is being raised (or lowered), for example, thereby significantly reducing the operating cycle of the stacker.

The pusher is moved to a home position outside of the region occupied by the turntable during rotation With the aid of sensors and is capable of being prepositioned adjacent to one side surface of a completed stack also with the aid of sensors) after the stack has been rotated and before the stack is lowered to the take-off position, thus, further reducing stacker cycle time.

The pusher may be utilized to push all completed stacks in only one direction (either "left" or "right") or to alternately push bundles in opposing directions onto an outfeed table and/or conveyor.

The system is controlled by a microprocessor which enables the operating parameters to be easily adjusted while providing a fast, operator-friendly system.

OBJECTS OF THE INVENTION

It is, therefore, one object of the present invention to provide a novel stacker utilizing self-positioning compression clips which are automatically positioned without the need for motor drives or controller.

Still another object of the present invention is to provide a novel method for compressing the signature stacks and simultaneously receiving the next signature stack to be compressed, which method is made possible through the use of novel self-positioning compression clips.

Still another object of the present invention is to provide a novel apparatus for compressing signature stacks through the employment of upper and lower self-positioning compression clip assemblies which cooperate with signature stack supports and a movable turntable to assure the compression of a completed signature stack (or stacks) without any degradation in stack alignment.

Still another object of the present invention is to provide novel stacking means for forming compressed signature stacks employing a reciprocatable split turntable having a center gap and a cooperating hydraulically driven pusher capable of passing through said gap to facilitate prepositioning of the pusher during turntable raising or lowering to thereby reduce cycle time.

Still another object of the present invention is to provide a novel apparatus for stacking and compressing signatures further including pusher means and turntable means for respectively ejecting and supporting signature stacks in which novel means are provided for displacing the pusher from the turning region during turntable rotation and for prepositioning the pusher preparatory to a pushing operation as the turntable is being lowered to further reduce the operating cycle.

Still another object of the present invention is to provide a stacker for forming aligned compressed bundles of signatures and the like through the utilization of upper and lower bins, the upper bin being provided with means for adjusting its bin size.

Still another object of the present invention is to provide a stacker for forming aligned compressed bundles of signatures and the like through the utilization of upper and lower bins, the upper bin being provided with novel jogging and signature compressing means for forming a neat, compact signature stack which is then delivered to the lower bin.

Still another object of the present invention is to provide a novel stacking apparatus for forming neat, compact compressed signature bundles including highly automated, microprocessor-based control means.

The above as well as other objects of the present invention will become apparent when reading the accompanying description and drawings.

DETAILED DESCRIPTION OF THE INVENTION AND PREFERRED EMBODIMENTS THEREOF

Figure 1A:
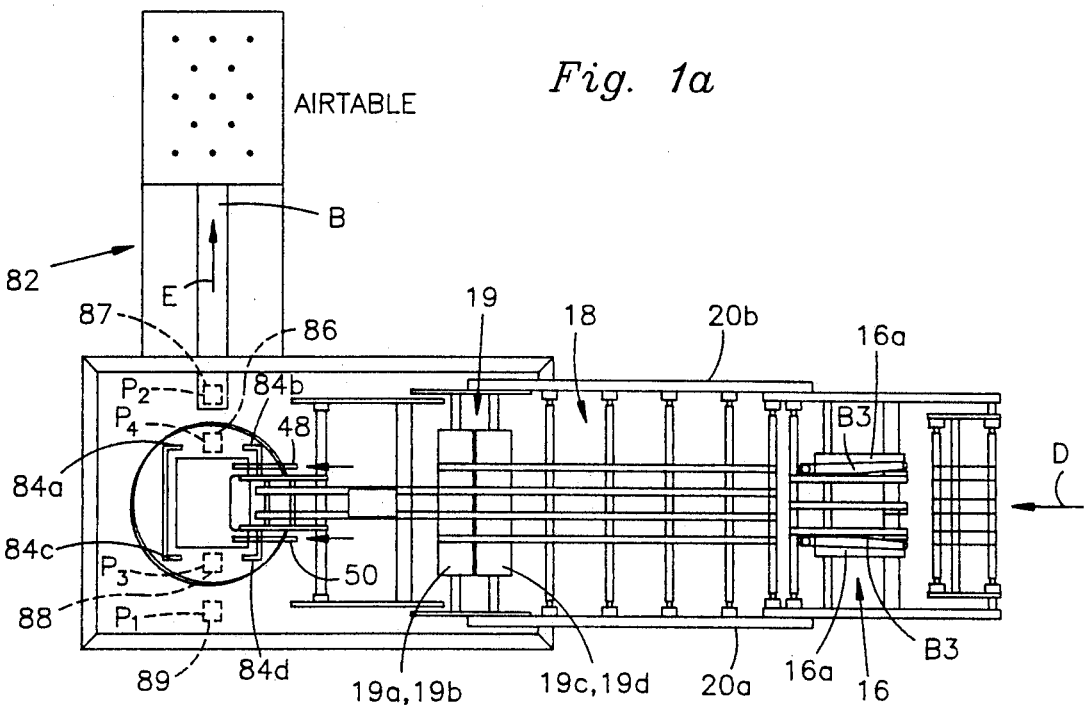
FIG. 1*a* shows a top plan view of the stacker of FIG. 1.
Figure 1:
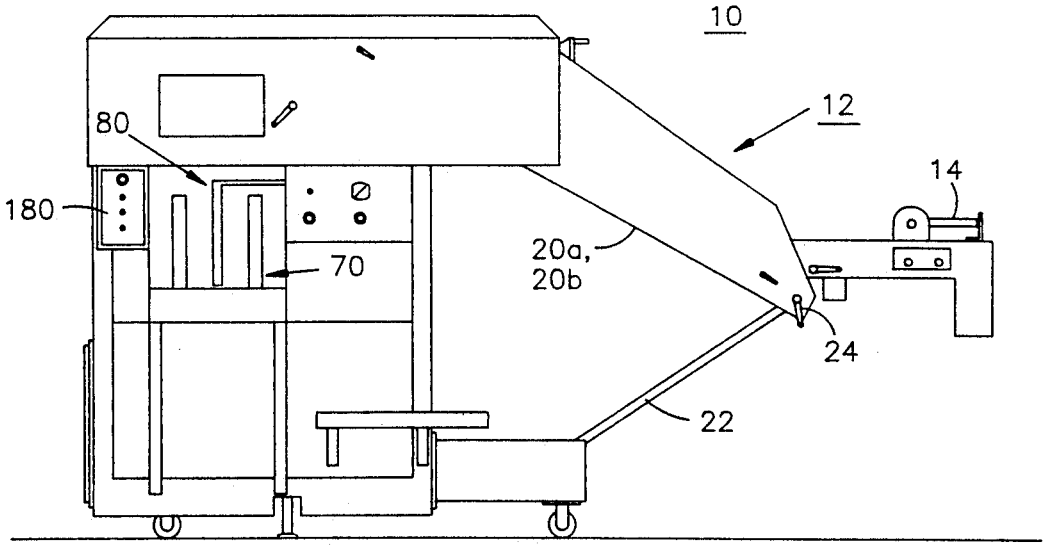
FIG. 1 shows an elevational view of a stacker embodying the principles of the present invention.
Figure 5:
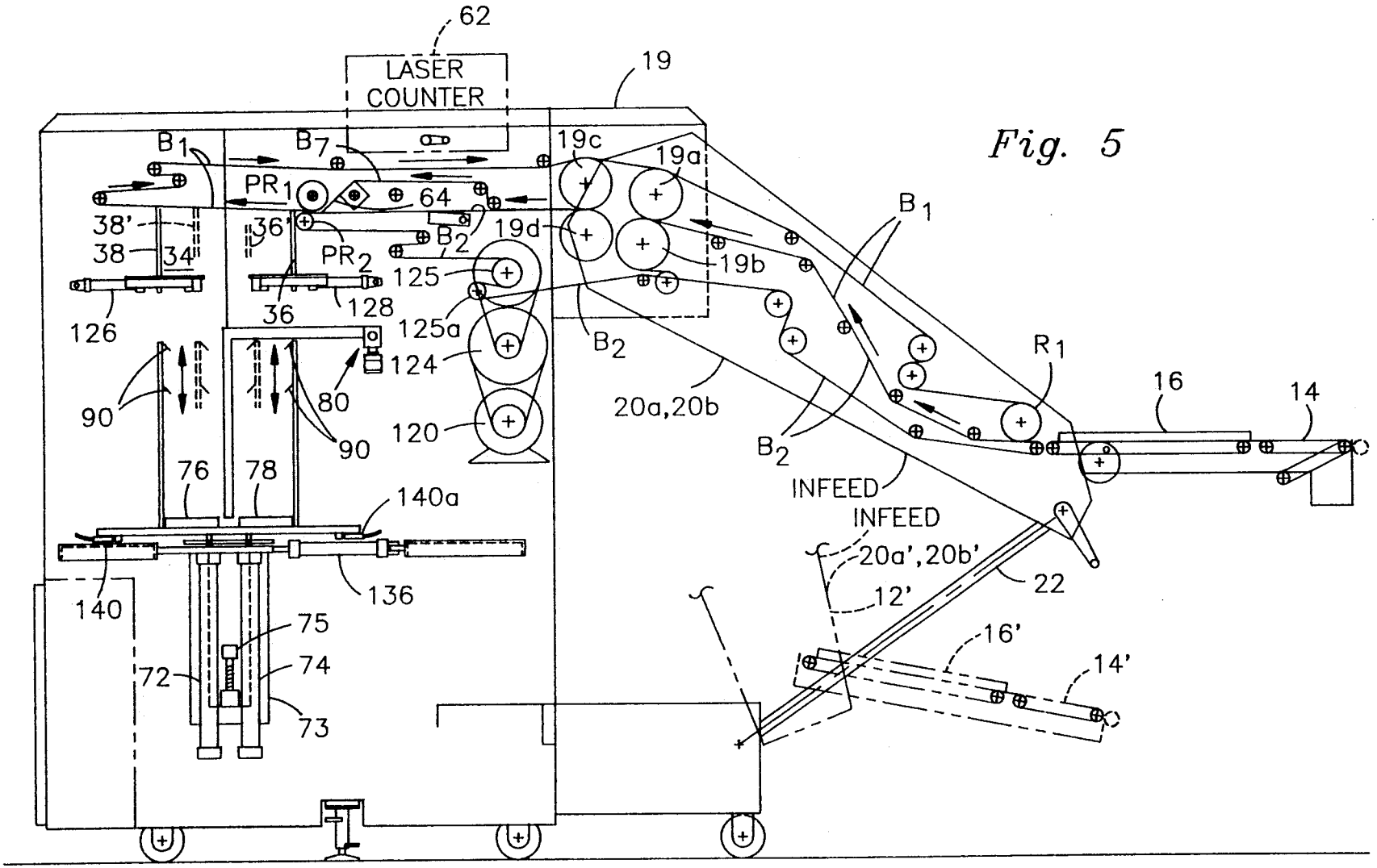
FIG. 5 is a detailed elevation of the stacker showing the various drive means.

FIGS. 1, 1*a* and 5 show a stacker 10 embodying the principles of the present invention and being comprised of an infeed section 12 having a diverter assembly 14 for diverting signatures away from the stacker and directing the signatures downwardly toward the floor F to prevent the stacker from being damaged. Downstream from the diverter is a stream aligner 16 which employs belts B3 to align skewed signatures within the stream and centers the stream for proper feeding. Belts B3, B3 are vertically aligned and engage the opposite sides of the signature stream. The belts B3, B3 taper from wide to narrow moving downstream to align the signatures. The signature stream, which is typically delivered to the stacker in overlapping or shingle form, with folded edges forward and a lap or a spacing between adjacent folded edges the range from two to four inches, passes through diverter 14, stream aligner 16 and enters between upper and lower infeed belts arranged in belt assembly 18 and are directed to pass between two pairs of squeeze rolls 19*a*, 19*b* and 19*c*, 19*d* forming a squeeze roll assembly 19. The squeeze rolls have hydraulic means to exert pressure on the signature stream passing therebetween to squeeze air out from between and among the signatures within the overlapping stream and to flatten or compress the folded edges.

Figure 1B:
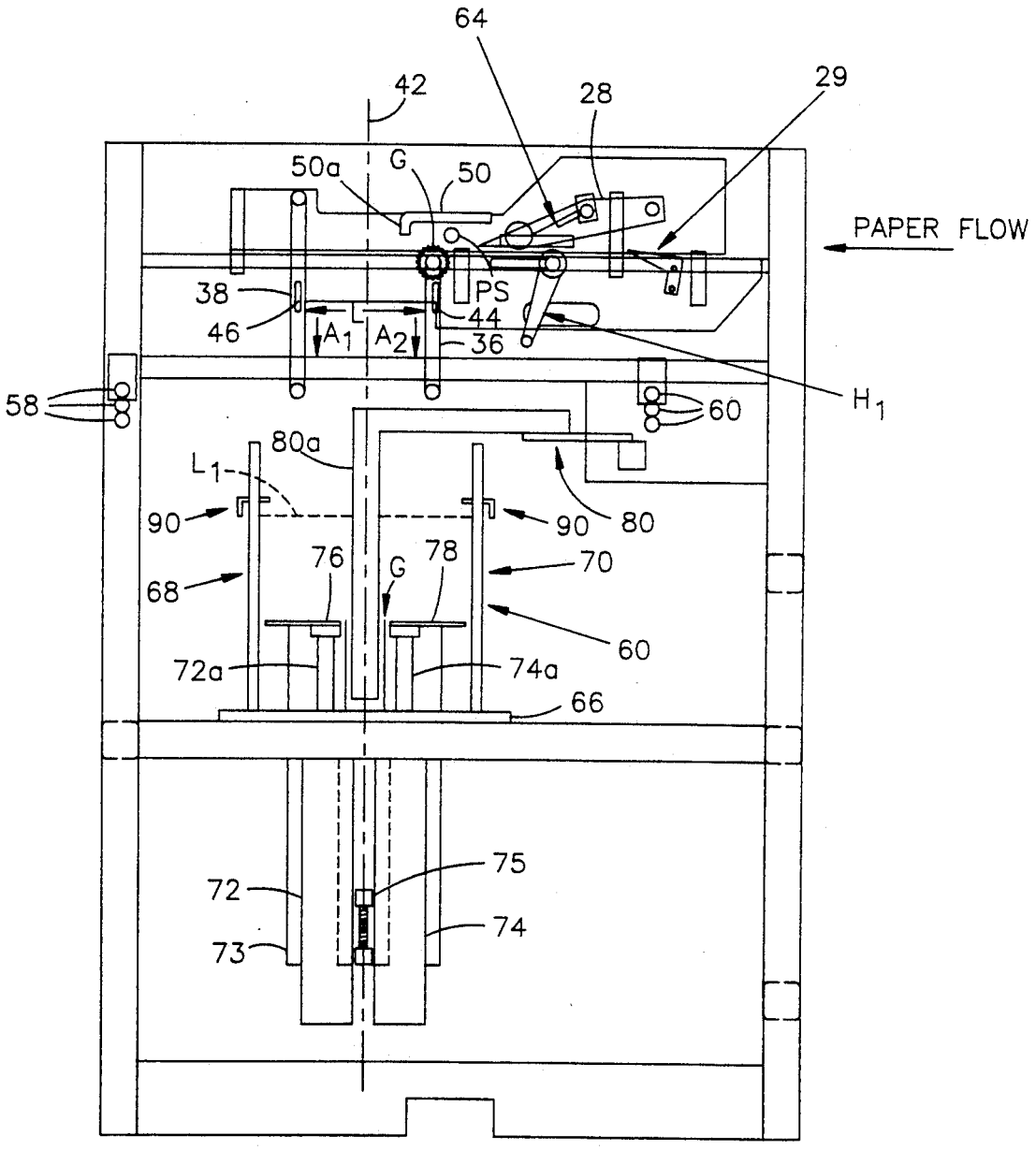
FIG. 1*b* shows an elevational view of the stacking section of the stacker shown in FIG. 1 and including an upper bin and a lower bin.
Figure 2:
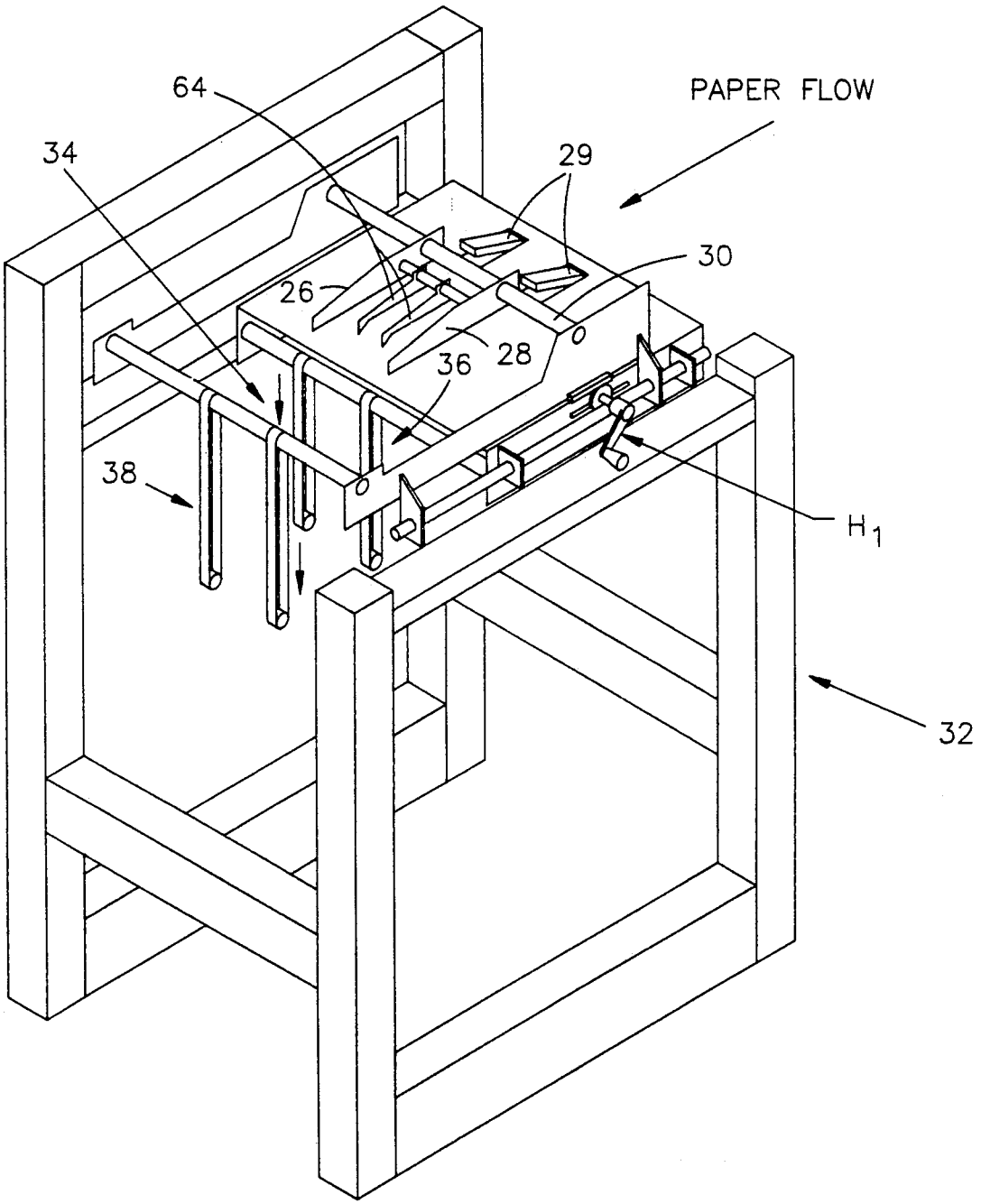
FIG. 2 is a perspective view of the stacker upper conveyor region including an upper bin.

The height of the stacker inlet end is adjustable relative to the floor F to accommodate a variety of delivery conveyors which are arranged at different distances from the floor in the range from fourteen to forty inches (see also FIG. 5). The infeed side plates 20*a*, 20*b* supporting the shafts which, in turn, support the infeed belts and squeeze roll pairs, are swingably mounted at their left-hand ends relative to FIGS. 1 and 1*a*. At least one elongated worm screw 22 is provided which cooperates with a threaded nut engaging the bottom end of worm screw 22. Operating handle 24 rotates the worm screw 22 either clockwise or counterclockwise to respectively raise or lower the infeed section 12 from upper position 12 to lower position 12' (FIG. 5) for appropriate alignment with a delivery conveyor (not shown for purposes of simplicity). The signatures passing between the pairs of squeeze rolls move beneath a pair of gapper supports 26, 28 which are shown in FIGS. 1*a*, 1*b* and 2. The supports are pivotally mounted to shaft 30 which is supported upon the stacker frame 32. The infeed belts shown in FIG. 1*a* serve to impart drive to the signature stream passing beneath supports 26, 28 and resting upon the lower belts B2. The upper belts B1 are displaced from the counting and gapping region as shown in FIG. 5.

Pivotally mounted lifters 29 raise the tails or trailing edges of signatures moving toward the gapper supports 26, 28 to reduce the drive imparted to signatures by the belts B2 and aid in starting and stopping of the products, especially heavier (i.e. thicker) products.

Signatures passing beneath supports 26, 28 are delivered to an upper bin 34 of generally rectangular parallelepiped shape and having upstream and downstream sides defined by the upstream and downstream belt assemblies 36 and 38 respectively. Two sides of upper bin 34 are provided with side or lateral walls 35, 37 (see FIG. 2*c*) which, in addition to serving as a sidewalls, are reciprocated to jog the signature stack building within the upper bin 34 for accurately aligning the signatures within the upper bin.

The length of the upper bin measured as the distance between the belt assemblies 36 and 38 is adjustable by way of the adjustment handle H1 which simultaneously moves the belt assemblies 36 and 38 relative to the bin centerline 42 in order to accommodate signatures of varying sizes measured in the length direction L, shown in FIG. 1*b*. The gear teeth of a gear G cooperate with proximity switch PS to produce pulses each representing movement of approximately ⅛ inch when rotated by lower belts B2 (see FIG. 5).

The upper end of belt assembly 38 extends a given distance above the upper end of belt assembly 36 and serves as a stop limiting movement of delivered signatures. Drive means (not shown for purposes of simplicity) rotate the shafts upon which the belt assemblies 36 and 38 are mounted to cause the adjacent runs of the belts defining the bin sidewalls to move downwardly in order to urge the signatures downwardly to the bottom of the upper bin. Jogging mechanism 44 is arranged behind the belts 36 and moves these belts in a reciprocating manner in a direction perpendicular to their downward movement for jogging the signatures engaging these belts.

The pair of tubes 48, 50, shown in FIGS. 1*a* and 1*b* receive compressed air from a source (not shown for purposes of simplicity) and have their forward ends bent downwardly as shown by the forward end 50*a* of hollow tubular member 50. These tubes direct pressurized air downwardly upon the topmost signature further aiding in the compression of the signature stack being developed in the upper bin.

Figure 2A:
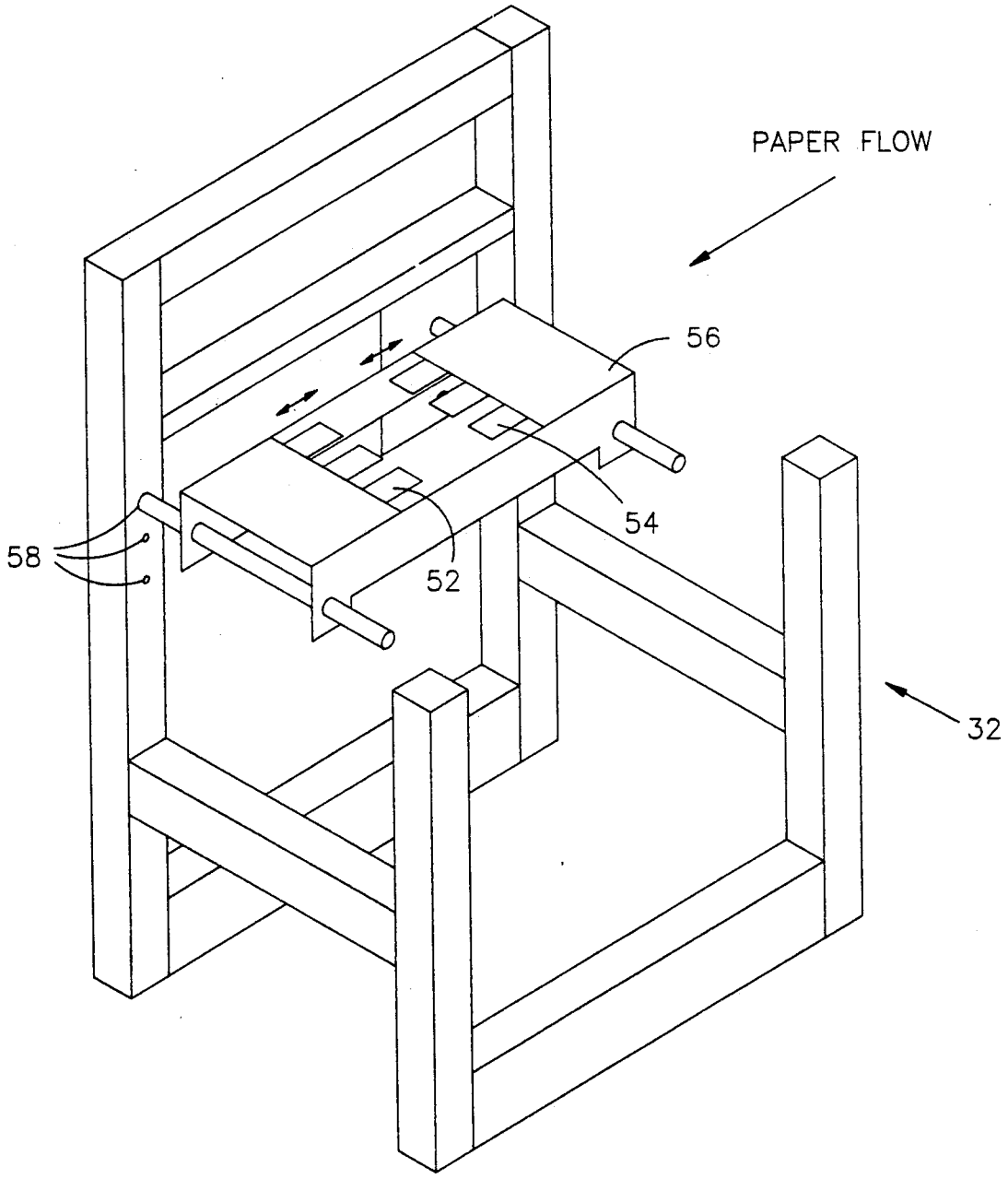
FIG. 2*a* is a perspective view of the upper bin reciprocating floor assembly.
Figure 2B:
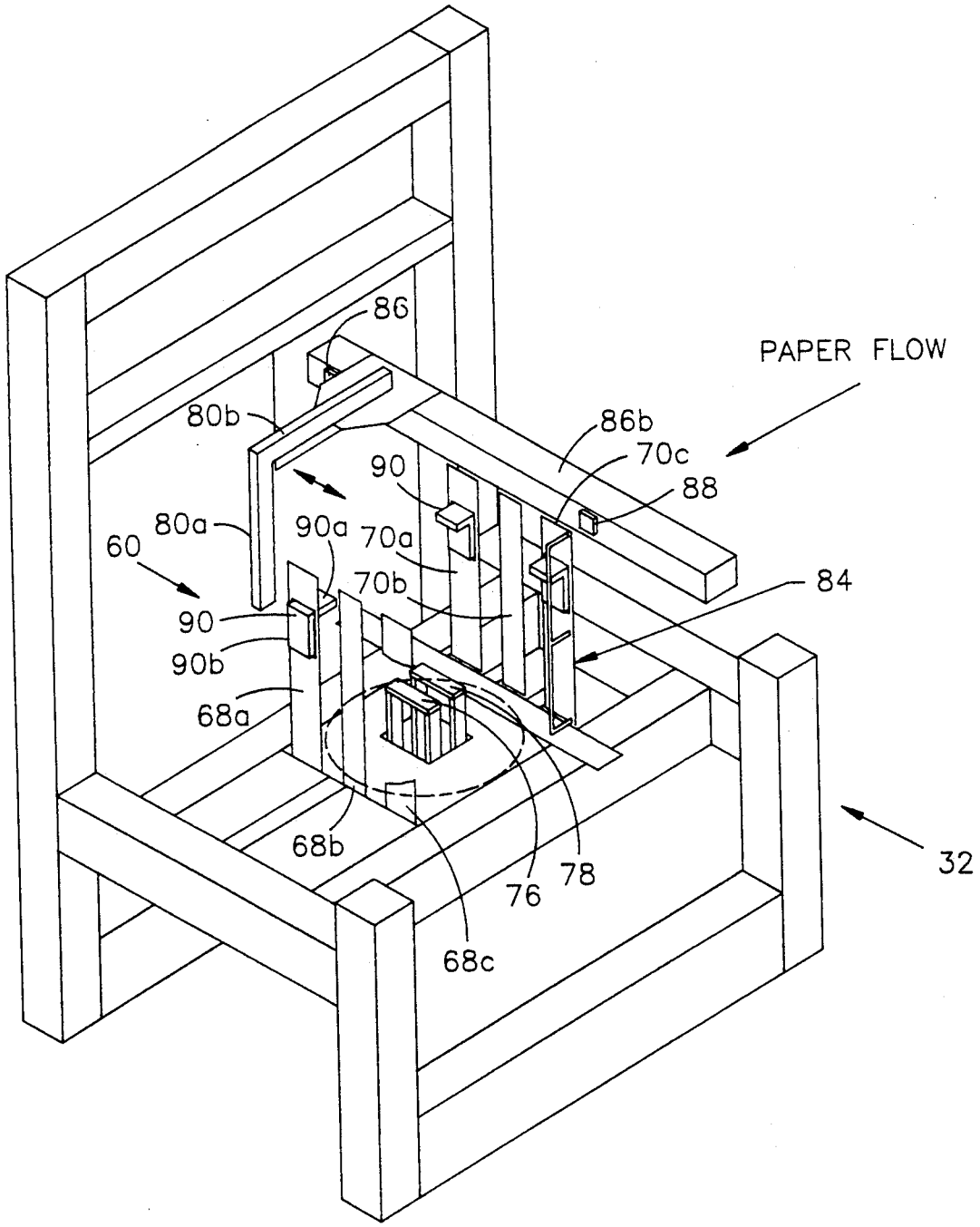
FIG. 2*b* is a perspective view of the stacker lower bin assembly.
Figures 2C, 2D:
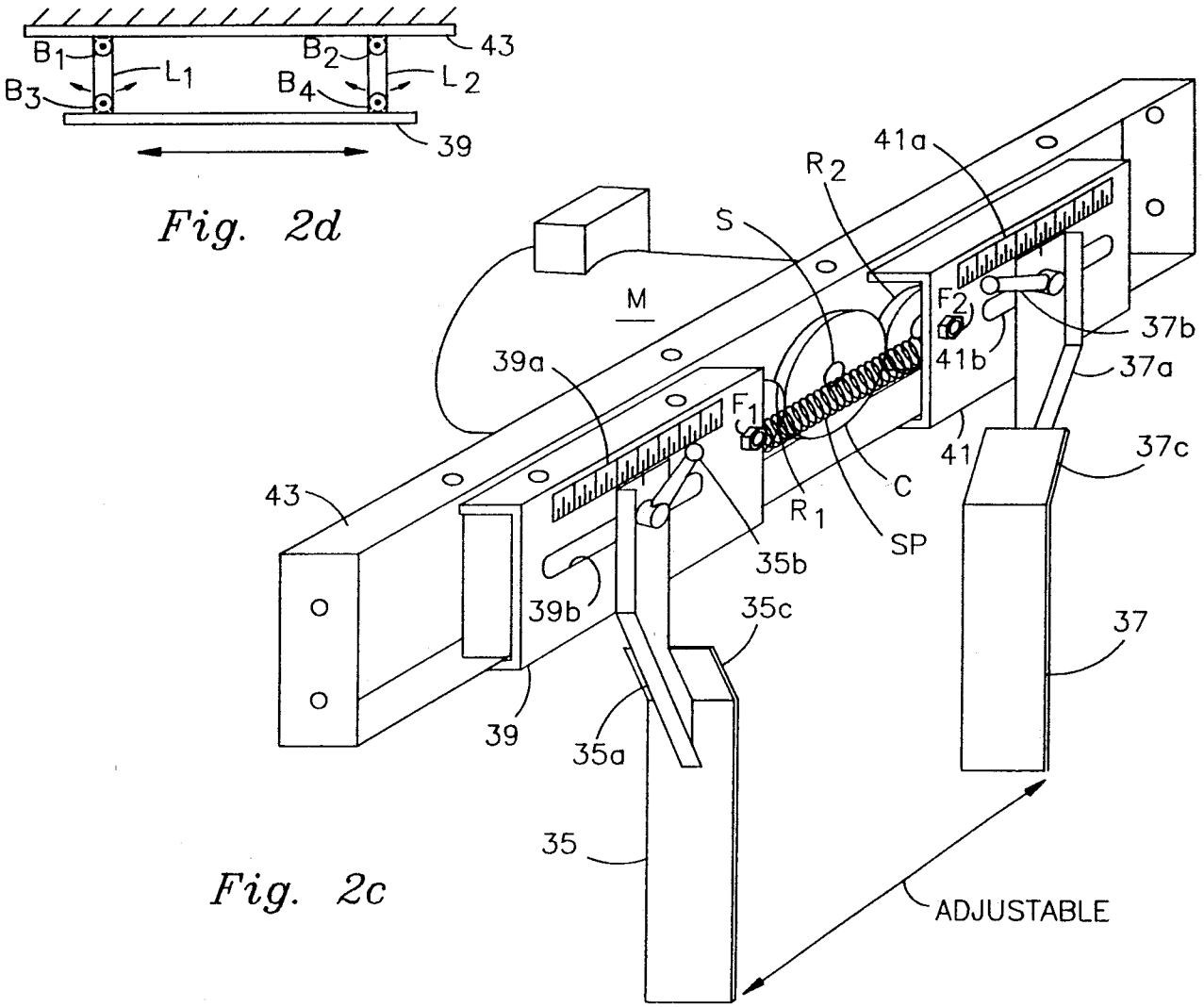
FIG. 2*c* is a perspective view of side jogger assemblies employed in the upper bin of FIG. 1*b;*
FIG. 2*d* is a simplified view showing the linkages employed to swingably mount the jogger assemblies of FIG. 2*c;*

The upper bin 34 has a pair of side joggers or paddles 35, 37 each secured to the lower end of a cooperating mounting bracket 35*a*, 37*a*, as shown in FIG. 2*d*. Each mounting bracket is releasably secured to a channel 39, 41. Each channel has a slot 39*a*, 41*a* for receiving a handle-operated threaded fastener having a handle 35*b*, 37*b* for adjusting the spacing between the joggers 35, 37. A marker indicia along the upper edge of brackets 35*a*, 37*a* cooperates with a graduated marker 39*a*, 41*a* arranged across each channel 39, 41 for adjusting the paddles so that they are separated by an equal distance from an imaginary centerline to assure that the upper bin sidewalls, defined by paddles 35, 37 are aligned with the signature stream flowing into the upper bin.

An elongated channel-shaped member 43 is mounted to the stacker frame and has a motor M secured to the rearward side thereof. Shaft S of motor M extends through a clearance opening in channel 43 and has a two-lobed eccentric cam C mounted thereon. The two-lobed cam C engages cam follower rollers R1 and R2 rotatably mounted on associated channel 39, 41 by fastening means F1, F2. A spring SP has its free end wrapped about one of said fasteners F1, F2 and normally urges channels 39, 41 toward one another.

Each of the channels 39, 41 is coupled to channel 43 by a pair of links. FIG. 2*d* shows the manner in which the links are arranged. Channel 43 is shown schematically in FIG. 2 as being provided with a pair of mounting brackets B1, B2 for respectively pivotally mounting one end of a swingable link L1, L2. Channel 39 is shown schematically in FIG. 2*d* as having a pair of mounting brackets B3, B4 for pivotally mounting the opposite ends of links L1, L2, respectively.

The manner of operation of the paddles 35, 37 is as follows:

When motor M is energized, its output shaft rotates the two-lobed cam C. The lobes upon the cam are mirror images of one another relative to an imaginary diameter of the cam such that the cam follower rollers R1 and R2 are driven apart distances from the center of cam C which are equal to one another about an imaginary vertical centerline passing through cam C, as the rollers R1, R2 engage portions of twin-lobed cam C which are further removed from the center thereof. As portions of the cam C which are closer to the center thereof engage cam follower rollers R1 and R2, these cam follower rollers are urged toward one another to follow the cam surface of cam C under the influence of tension spring SP. This results in high speed reciprocation of the paddles 35, 37 which serve to jog the lateral sides of signatures as they drop into and are collected in upper bin 34. The upper ends of paddles 35, 37 are bent outwardly to form guide surfaces 35*c*, 37*c* which act to guide the signatures delivered to the upper bin into the bin.

The floor of the upper bin 34 is defined by first and second reciprocating plate assemblies 52, 54 shown best in FIG. 2*a* and arranged to reciprocate toward and away from one another, said plate assemblies being movably mounted upon a support 56, which, in turn, is adjustably positioned to one of three vertical heights by means of pins received within openings 58 and 60 arranged upon the stacker frame. Hydraulic means (not shown for purposes of simplicity) move the plates 52, 54 in a reciprocating fashion. Plates 52, 54 are moved toward one another to provide a floor for supporting signatures within the upper bin. When an appropriate count of signatures have been delivered to the upper bin 34, hydraulic drive means rapidly move the plates 52 and 54 apart allowing the collected stack to drop into the lower bin 60 to be more fully described. Plates 52, 54 have clearance slots 52*a*, 54*a* for the belts of assemblies 36, 38 to permit interference-free operation of belt assemblies 36, 38 and plates 52, 54.

Figure 3:
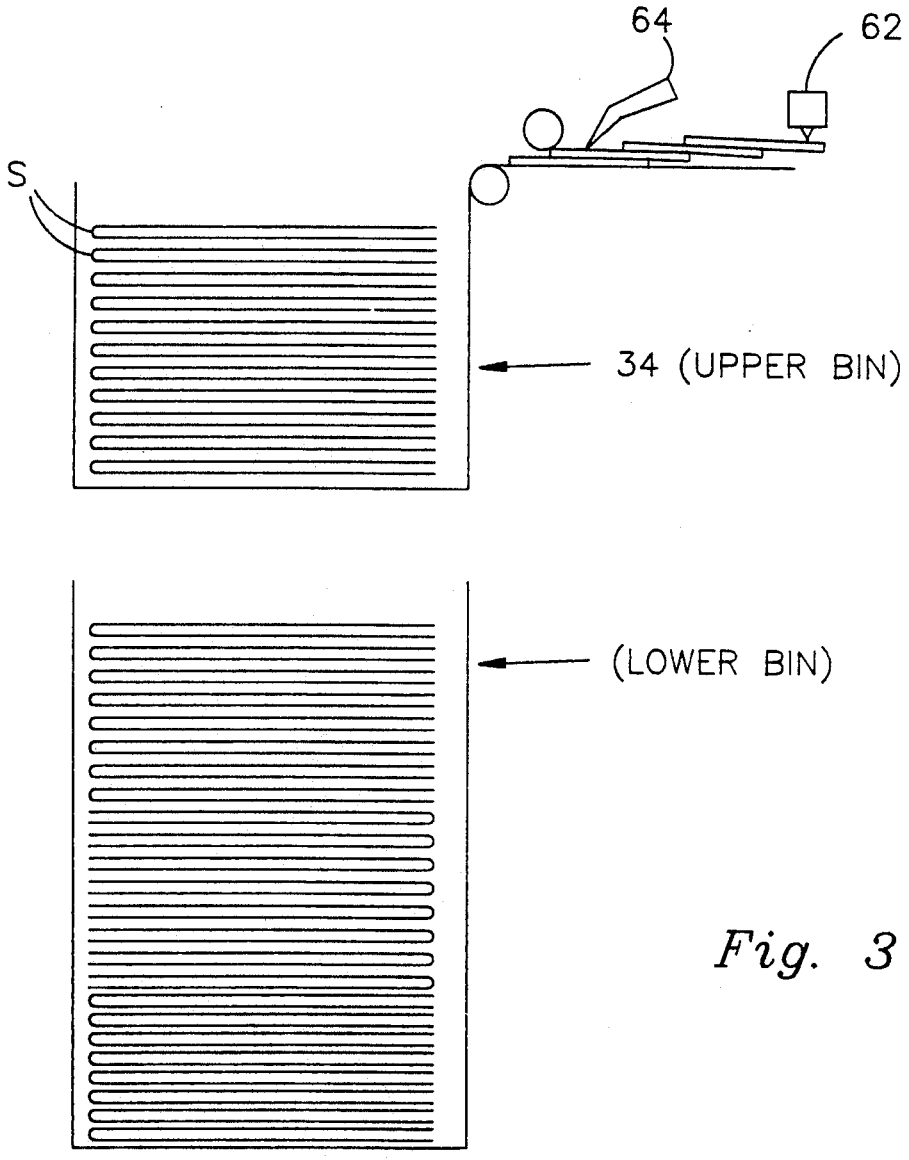
FIG. 3 is a diagrammatic elevational view of the stacker useful in explaining bundle formation.

A counter 62 shown in FIG. 3 is positioned upstream relative to a pile gapper assembly 64 comprised of two swingably mounted gapper supports 26, 28. Counter 62 incorporates a sensor which is preferably of the non-contact type such as an infrared counter. When a predetermined number of signatures have passed the sensor of counter 62, the counter causes the opening of plates 52, 54 to be initiated after a predetermined delay sufficient to allow the last signature in the stack to be collected within the upper bin to move from the position of the counter 62 into the upper bin and be settled therein.

The count signal also activates the gapper assembly 64 whose free ends are swung downwardly to engage the leading edge of those signatures which are upstream of the last signature to be collected in the upper bin in order to temporarily restrain these signatures from being delivered to the upper bin for a period of time sufficient to allow the signatures S in the upper bin 34 (see FIG. 3) to settle and to be dropped into the lower bin 60. The plates 52 and 54 are then returned to the closed position in readiness to receive and support the next batch of signatures to be stacked within upper bin 34.

Lower bin 60, shown in FIGS. 1*b* and 2*b*, is comprised of a rotatably mounted turntable 66 having side supports 68 and 70 arranged upon the turntable and defining two parallel walls which support, retain and align the stacks of signatures delivered thereto.

A pair of cylinders 72 and 74 beneath the floor of the lower bin are arranged to rotate with turntable 66. The cylinder pistons 72*a*, 74*a* are appropriately raised and lowered by their respective cylinders to perform a stack compression operation as will be more fully described. Compression plates 76 and 78 are mounted upon the free ends of pistons 72*a*, 74*a* and serve as a platform for supporting signature stacks delivered to lower bin 60. The adjacent edges of these plates are spaced apart by a given distance to provide a clearance gap G through which the vertical pusher bar 80*a* of a pusher assembly may extend. The pusher assembly comprises a cylinder 80*b* for moving pusher arm 80*a*, coupled to the cylinder drive by arm 80*c* in a direction shown by arrow E in FIG. 1*a* which is transverse to the delivery direction and the direction of movement of signatures into the stacker as shown by arrow D in FIG. 1*a*.

Pusher bar 80*a* is movable from a home position P1 to a home position P2 shown in FIG. 1*a*. The pusher bar is utilized to eject completed bundles out of lower bin 60 and onto a take-off assembly 82 which may be comprised of an air table.

The corner support members 68*a*, 68*c* and 70*a*, 70*c* are provided with adjustable gates such as, for example, the adjustable gate 84 shown in FIG. 2*b* which is swingably mounted to the corner support 70*c* and is movable between a closed position engaging the sides of the signature stacks spanning between the sidewalls 68 and 70, and an opened position enabling a completed signature bundle to be pushed off of the turntable and onto the take-off assembly 82, for example.

Preferably, four such adjustable guides are provided. These guides cooperate with the supports 68 and 70 to retain the signatures collected upon the turntable in proper alignment when the turntable is rapidly rotated through 180° in order to form a compensated bundle, as will be more fully described.

Although FIG. 1*a* shows a take-off assembly 82 arranged on one side of the stacker 10, the take-off assembly may be arranged on the opposite side or on both sides of the stacker. Pusher arm 80*a* may be operated to push all bundles off to one side; all bundles off to the other side; or to alternately push bundles off to one side and to the other in the respective cases where the take-off assembly may be arranged to one side of the stacker; to the other side of the stacker; or may be arranged on both sides of the stacker. Employing the arrangement of FIG. 1, for example, the pusher occupies the initial home position P1 and is moved towards the position P2 to push a completed bundle onto the take-off assembly 82. The pusher is then returned to position Pl in readiness for pushing the next bundle. The movement returning the pusher toward position P1 may occur simultaneously with the raising of the platform in readiness to receive a signature stack thereby reducing the system operating cycle.

The pusher assembly 80 is provided with sensors 86, 88, 87, 89 which permit the prepositioning of the pusher. The manner of operation is as follows:

In the arrangement shown in FIG. 1*a* the pusher initially occupies the position P1 thereby displacing the pusher from the turntable a distance sufficient to provide adequate clearance for all of the turntable components during rotation of the turntable. Assuming that a turntable rotation has been completed, the pusher may be moved to position P3 as sensed by sensor 88, for example, in order to be prepositioned to move a completed bundle out of the lower bin 84. Position P3 places the pusher arm 80*a* immediately adjacent to one side of the completed bundle. As soon as the turntable is lowered to its bottom position and at least the gates 84*a* and 84*b* have been swung open, the pusher may then be immediately accelerated to push the completed bundle out of the lower bin and onto the take-off table. In the absence of such prepositioning, initiating movement of the pusher arm from position P1 would cause a severe impact of the pusher arm against the adjacent side of the completed bundle, significantly disrupting signature alignment of the bundle. The movement of the pusher arm to the eject-ready position P3 is performed as the turntable is being lowered subsequent to completion of a compression operation, thereby reducing the system operating cycle.

Figure 4A:
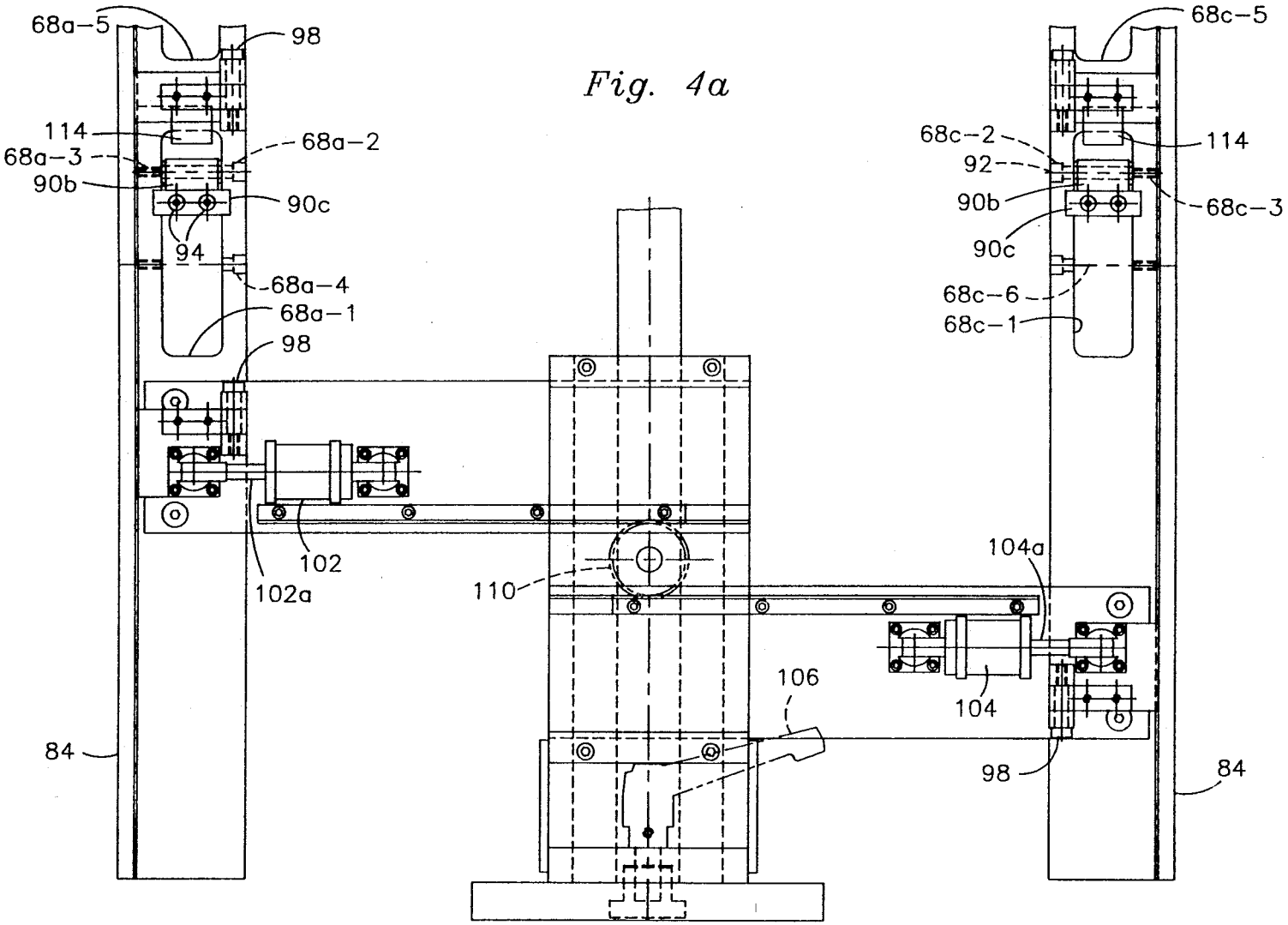
FIG. 4*a* is an elevational view of one of the lower bin stack supports.
Figure 4B:
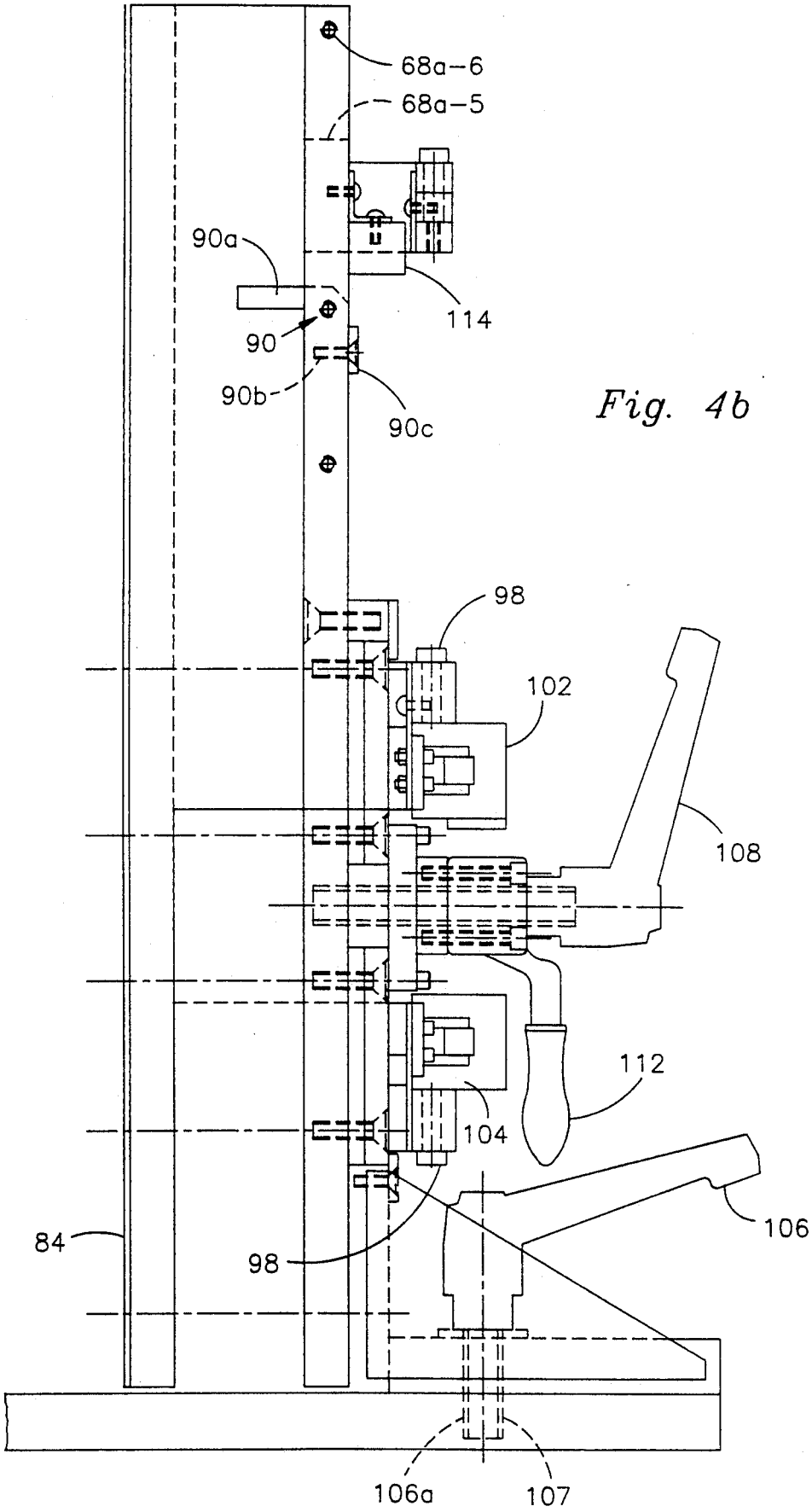
FIG. 4*b* is an end view of one of the supports shown in FIG. 4*a;*

In order to form a bundle in which the top and bottom surfaces are as close to parallel as is possible, it is known to compress a signature stack in order to reduce the thickness of the folded edge side of the stack so that it is more nearly equal to the cut edge side. This is accomplished through the use of the compression clips 90 which are swingably mounted upon each of the corner supports 68*a*, 68*c*, 70*a*, and 70*c* shown, for example, in FIG. 2*b*. The compression clips are substantially L-shaped members having first and second integral arms 90*a*, 90*b*. Each of the supports, such as, for example, the supports 68*a*, 68*c*, shown in FIG. 4*a* are provided with elongated, substantially rectangular-shaped slots 68*a*-1, 68*c*-1 for receiving and mounting the compression clips 90, 90 in the manner shown. Pins 92, 92 extend through suitable openings within supports 68*a*, 68*c* and preferably have a threaded portion for threadedly engaging a threaded portion 68*a*-3 and 68*c*-3 of the openings 68*a*-2 and 68*c*-2 receiving pins 92, 92. A catch plate 90*c* is secured by fastening means 94 to the outer surface of each arm 90*b*. The catch plate spans across the slot, such as slot 68*a*-1 and engages the marginal surface of the support adjacent to the slot. Catch plates 90*c* serve the function of preventing rotation of the compression clips when the catch plates engage the support arm as shown, for example, in FIG. 4*b*, preventing the clip arm 90*a* from rotating clockwise, thereby maintaining the clip arm in horizontal alignment during a stack compression operation, as will be more fully described. The catch plates 90*c* further serve the function of increasing the weight of the lever arm to the right side of the pivot pin 92 (see FIG. 4*b*) relative to the left side of the pivot pin to normally maintain the compression clip arm 90*a* in substantially horizontal alignment as shown in FIG. 4*b*.

The operation of the compression clips and turntable compression assembly is as follows:

The compression plates are raised to a position L1 just below the compression clips 90 and at a position sufficient to maintain the compression clip arms 90*a* horizontal to support a completed stack delivered from upper bin 34 to lower bin 60 by pulling the floor plates 52, 54 out from beneath the signature stack within the upper bin. The signatures drop downwardly and are guided onto the clip arms 90*a* by the supports 68 and 70. The compression plates are then moved downwardly. As the signature stack passes the compression clips, the compression clip arms 90*a* are engaged by the signature stack and moved downwardly so that they are substantially flush with the signature supporting surfaces of supports 68 and 70. The top of the stack extends to a position which is higher than the compression clips. When the stack delivered to the compression plates 76, 78 has settled, after a predetermined delay, cylinders 72, 74 are operated to lower the compression plates and hence the signature stack a distance sufficient to allow the compression clips to clear the top of the stack enabling the clip arms 90*a* to be returned to their normal horizontal orientation. The compression plates are initially raised to the location L1 to reduce the free fall distance between the floor plates 52–54 and compression plates 76 and 78 with the objective of assuring the formation of a neat bundle of aligned signatures.

When the compression plates have been lowered to a level sufficient to enable the compression clip arms to return to a horizontal orientation, which results simply from the design of the compression clips and without the need for any drive means whatsoever, cylinders 72 and 74 are operated to raise compression plates 76, 78 causing the signature stack to be compressed between compression plates 76, 78 and clip arms 90*a*. The signature stacks are delivered in such a manner that the folded edges thereof are aligned with at least one set of compression clips.

The cylinders impart a force upon the compression plates sufficient to compress the signature stack in order to reduce the folded edges of the signatures to a thickness nearly that of the cut edges.

During compression, the turntable is rotated through a 180° angle with the guides 84 in the closed position (see FIGS. 1*a* and 2*b*). The next stack is dropped upon the clip arms 90*a* which support the stack as the previous stack is being compressed thereby reducing the operating cycle. The turntable is then lowered to place the last-received stack from upper bin 34 beneath clips 90.

The timing of the system is such that the next stack is dropped from upper bin 34 onto the top surfaces of clip arms 90*a* whereupon when the compression plates are lowered, the signature stack resting upon the compression clip arms 90*a* moves downwardly the stack being supported by the clip arms 90*a* is also lowered, moving the clip arms out of the downward path of movement of the signature stack. The compression plates are again lowered to a position sufficient to allow the top compression clip arms 90*a* to clear the top signature and return to the horizontal orientation whereupon a subsequent compression operation is performed by operation of cylinders 72, 74 to raise the compression plates 76, 78.

FIGS. 4*a* and 4*b* show further details of the lower bin including the cylinder-driven swingable gates 84. The left and right-hand gates are each swingably mounted to supports 68*a*, 68*c* by pins 98, 100. Cylinders 102, 104 operate their pistons 102*a*, 104*a* to swing the gates from the solid line positions which represent the closed gates to an open position. For example, noting FIG. 4*c*, piston 100*a* is moved to the left causing gate 84 to rotate clockwise about its pivot pin as represented by arrow A3 to the opened position. The gates may be moved to the closed position simply by moving the piston 100*a* in the opposite direction. All the gates operate in substantially the same manner.

The lower bin is adjustable in mutually perpendicular directions in order to accommodate signatures within the size range mentioned hereinabove.

Figure 4C:
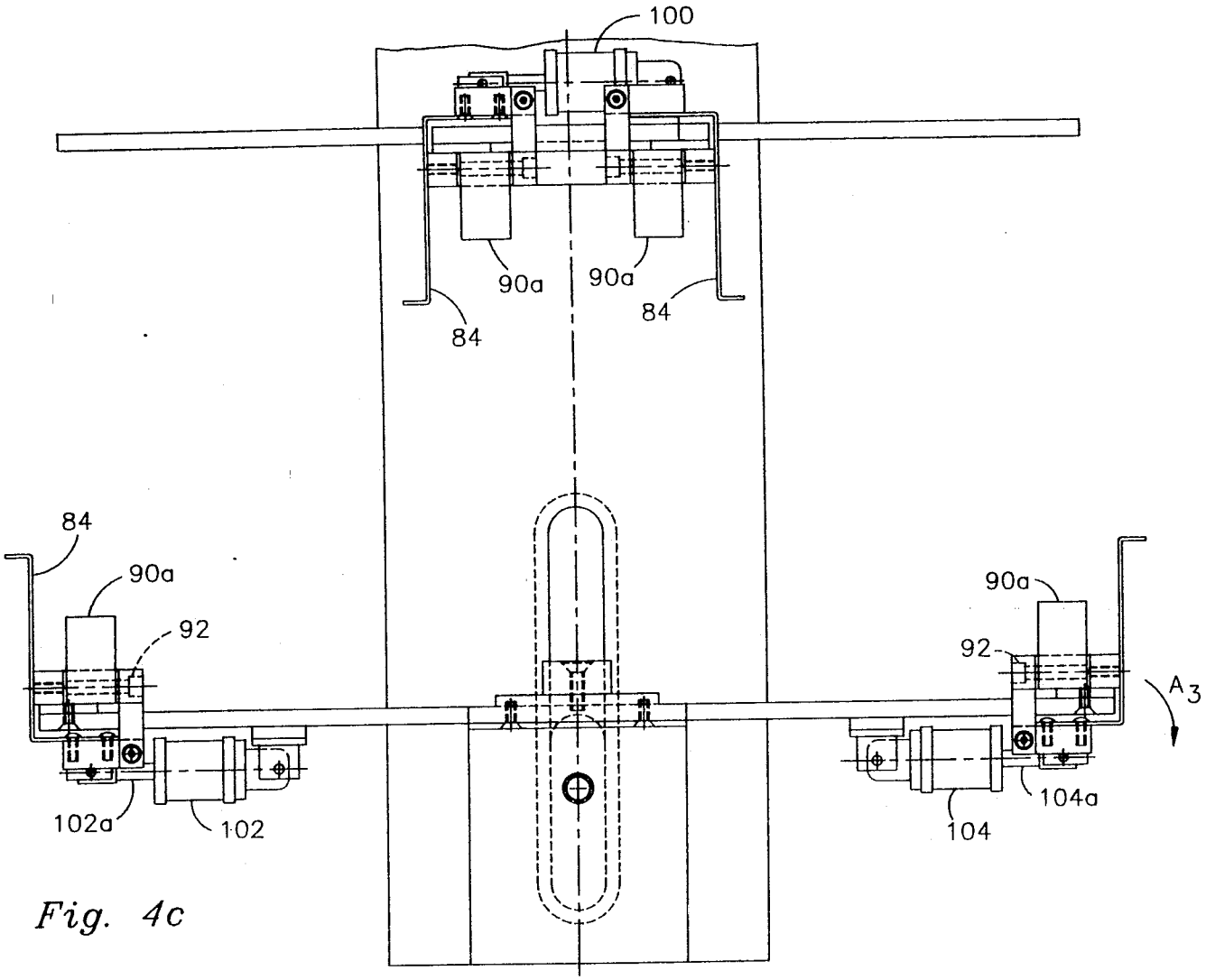
FIG. 4*c* is a plan view of the lower bin supports.

For example, handle 106 having a lower threaded end 106*a* which threadedly engages a tapped opening 107 in the stacker frame permits adjustment of the bin size by moving the pairs of uprights 68 and 70 closer to one another or further apart to accommodate respectively smaller or larger sized signatures. Operating handle 112 (FIG. 4*b*) is coupled to a spur gear 110 (FIG. 4*a*) which, upon rotation in the clockwise direction, moves the outer uprights 68*a*, 68*c* closer to one another and by movement in the counterclockwise direction moves the outer uprights 68*a*, 68*c* further apart in order to respectively accommodate signatures of smaller or larger size. Operating handle 108 is adjusted to retain the desired position of handle 112 and hence spur gear 110 by locking the handle into the desired position. FIG. 4*c*shows the uprights 68*a*, 68*c* in the position furthest removed from one another to accommodate signatures of large size whereas supports 70*a*, 70*c* are shown moved to the position for accommodating the smallest size signature. Obviously, it should be understood that the end supports of the supports assemblies 68 and 70 should be aligned in actual use.

The end supports are each preferably provided with a plurality of pin receiving openings for receiving the pins 92 in order to mount the compression clips at a plurality of different heights. For example, the compression clip mounted in support 68*a* is in the upper position which is utilized to accommodate thinner products, i.e. signatures having a smaller number of pages. Opening 68*a*-4 is utilized when handling thicker products, the position of the clips being selected to assure that when the stack of signatures are first received from the upper bin and supported on the clip arms 90*a* that the height of the stack does not exceed the distance measured between the compression clips and the tops of the uprights in order to assure that all of the signatures within the stack delivered from the upper bin are supported and maintained in alignment by the supports 68 and 70. Thus, when stacking thinner products, the clips may be mounted to pivot about the upper opening 68*a*-2 whereas when thicker products are being stacked, the clips may be lowered to pivot about the opening 68*a*-4. If desired, a middle position may be utilized to accommodate products in a mid-range of thickness.

Since it is important to provide for alignment of the signature stack received from the upper bin preparatory to its compression, there is an upper limit to the position at which the clips may be mounted upon the uprights, this upper position being represented by the opening 68*a*-2, for example, in upright 68*a*. In many instances, the last signature stack delivered from the upper bin to the lower bin to complete the bundle will often produce a bundle having a height which is greater than the distance between the bottommost position of the compression plates 76, 78 and the compression clip arms 90*a* necessitating that the last stack and hence the completed bundle must forego a compression operation.

In order to provide a compression operation for the completed bundle, in those cases where the height of the completed bundle is greater than the distance between the bottom of the lower bin and the compression clips, a second set of compression clips is provided. Note, for example, FIGS. 4*a* and 4*b* in which the end supports are provided with elongated substantially rectangular-shaped slots 68*a*-5 and 68*c*-5 each of which is adapted to receive a compression clip. Note FIG. 4*b* which shows the location of the opening 68*a*-6 for receiving a pin 92 to mount an upper compression clip.

Upper compression clips are mounted in a like fashion in each of the corner posts of the supports 68 and 70. The upper set of compression clips are substantially identical in design and function to the lower compression clips in that the clip arms 90*a* are normally maintained in horizontal orientation and swing downwardly to move out of the way of a stack being dropped into the lower bin from the upper bin merely by the engagement of the clip arms 90*a* by the signature stack being dropped into the lower bin. The upper set of compression clips are not utilized for compression of those signature stacks delivered to the lower bin prior to the last signature stack. However, upon receipt of the last signature stack, the lower end of the signature stack will occupy a position below the lower set of compression clips. However, the upper surface of the last 1 signature stack will be at a position above the lower compression clips and, since the compression plates cannot be lowered sufficiently to place the top of the last stack beneath the lower clips, it is not possible to use the lower compression clips for compression of the completed bundle. However, through the use of the upper compression clips, the completed bundle may be lowered sufficiently to cause the top of the completed bundle to clear the upper compression clips enabling the clip arms 90*a* to return to their horizontal orientation at which time the compression plates may be raised to compress the completed bundle. In order to retain the lower compression clips in the position with their clip arms 90*a* in substantially vertical orientation, electromagnetic means 114 may be provided to magnetically attract the catch plate 90*c* and thereby hold the lower compression clip in this position during the compression of the completed bundle which, upon completion of compression, : may be released to enable the lower compression clips to return to the position with their clip arms 90*a* in the horizontal orientation.

FIG. 5 shows a schematic view of the stacker 10 incorporating all of the motor and hydraulic drives. Main motor 120 provides drive for all of the conveyor belts through a speed reduction means 124 and drive shaft 125. Upper and lower belt sets B1 and B2 guide signatures passing diverter 14 and stream aligner 16 up to the two pairs of squeeze rolls 19*a*, 19*b* and 19*c*, 19*d*. The signatures emerge from the downstream end of the squeeze rolls and pass through the sensor and gapper region. There are preferably four belts. The lower set B2 of four belts are each arranged about one of four pulleys 125*a* mounted to rotate upon a common shaft, only one pulley being shown in FIG. 5. Two of the set of four upper belts B1 (only one belt being shown in FIG. 5) are looped between the upstream roller R1 and the downstream squeeze roll 19*c*. The remaining two (belts) extend into the counting and upper bin region. Belts B1 and B2 are aligned with one another. The upper belts B1 are displaced upwardly above the gapper 62 and the counter region 64 and are directed downwardly to move between pinch rolls PR1, PR2 over the top of upper bin 34 and return to the infeed section. The upper sets of belts B1 extend over the top of the belt assemblies 36, 38 and serve to aid in driving the signatures into the upper bin 34. Only the lower belts B2 drive signatures through the counting and gapping region enabling the gapper 64 to exert better control over the signatures. Lifters 29 aid in the handling of signatures as they pass through the counting and gapping region.

Figure 5A:
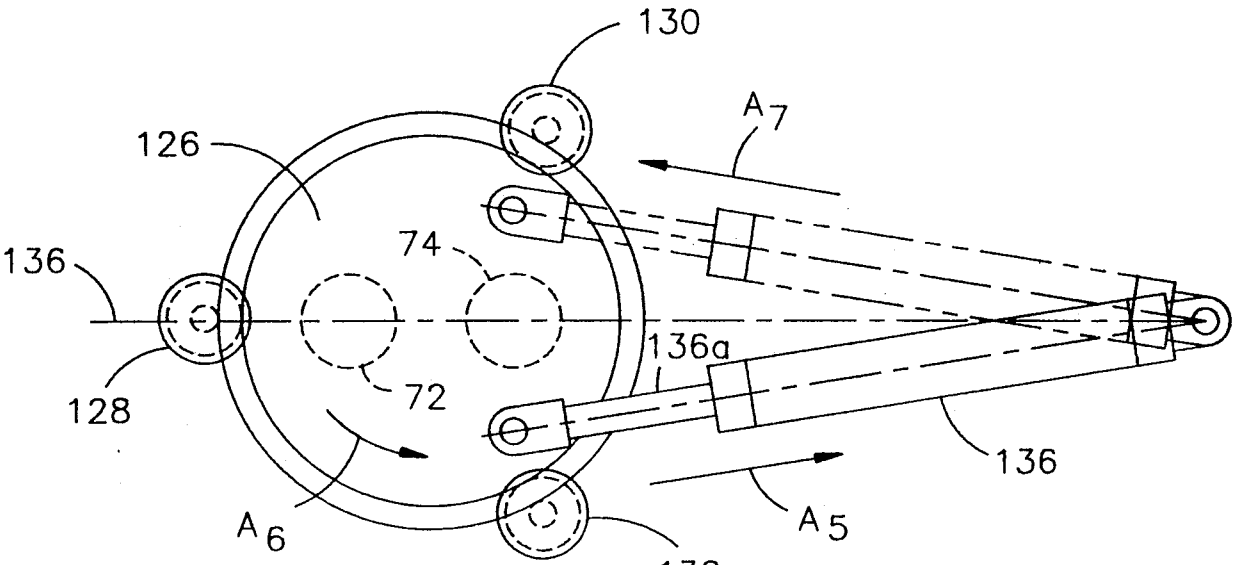
FIGS. 5*a* and 5*b* are top and elevational views, respectively, of the lower bin turntable.
Figure 5B:
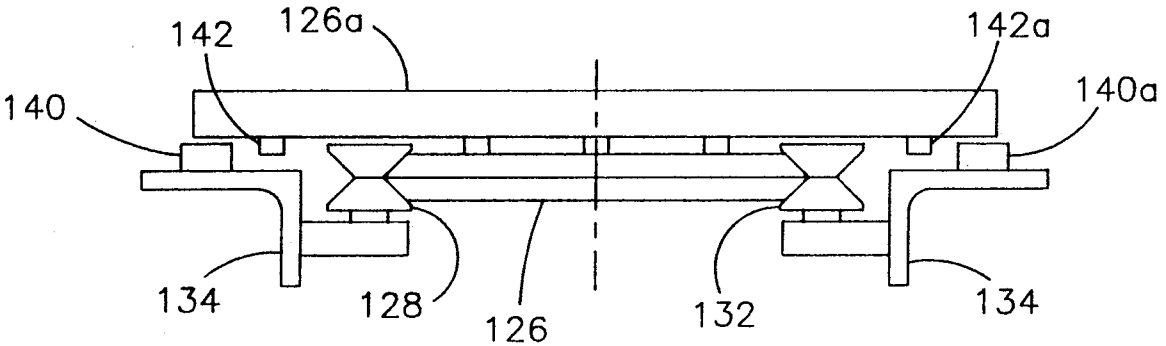

Cylinders 126 and 128 are utilized to operate the reciprocating plates 52 and 54 (see FIG. 2*a*). The turntable includes a circular-shaped disc 126 shown in FIGS. 5, 5*a* and 5*b* and having a substantially V-shaped periphery which conforms to the V-shaped periphery of three supporting rollers 128, 130 and 132 which are mounted to free-wheelingly rotate and are supported upon the stacker frame by means of mounting brackets such as, for example, mounting bracket 134 shown in FIG. 5*b*. The turntable 126 is rotatably mounted by the rollers 128, 130 and 132 and is driven by cylinder 136. When cylinder 136 is in the solid line position shown in FIG. 5*a*, its piston is moved to the right as shown by arrow A5 causing turntable 126 to rotate in the counterclockwise direction as shown by arrow A6. As soon as the cylinder 136 is aligned with centerline 138, which is sensed by sensor 140 cooperating with a sensed element 142 provided on the underside of the platform 126*a* secured to turntable 126, the hydraulic fluid pressure coupled to cylinder 136 is reversed causing the piston to be urged outwardly in a direction shown by arrow A6 to move the turntable through 180°. Thus, piston 136*a* is driven in the rightward direction during approximately 90° of the 180° turn and is thereafter moved in the leftward direction shown by arrow A7 for the remaining 90° of the 180° turn. The turntable is then rotated in the reverse direction during the next rotation operation and thereafter alternates between clockwise and counterclockwise rotation. This arrangement limits the amount of twisting and turning experienced by the electrical and hydraulic leads which rotate with the turntable.

Compression plates 76, 78 are raised and lowered by cylinders 72, 74. The plates 76, 78 are joined to move together by U-shaped member 73 (see FIG. 5) which raises and lowers with plates 76, 78. An adjustable rubber bumper 75 limits the upper movement of plates 76, 78.

Figure 6A:
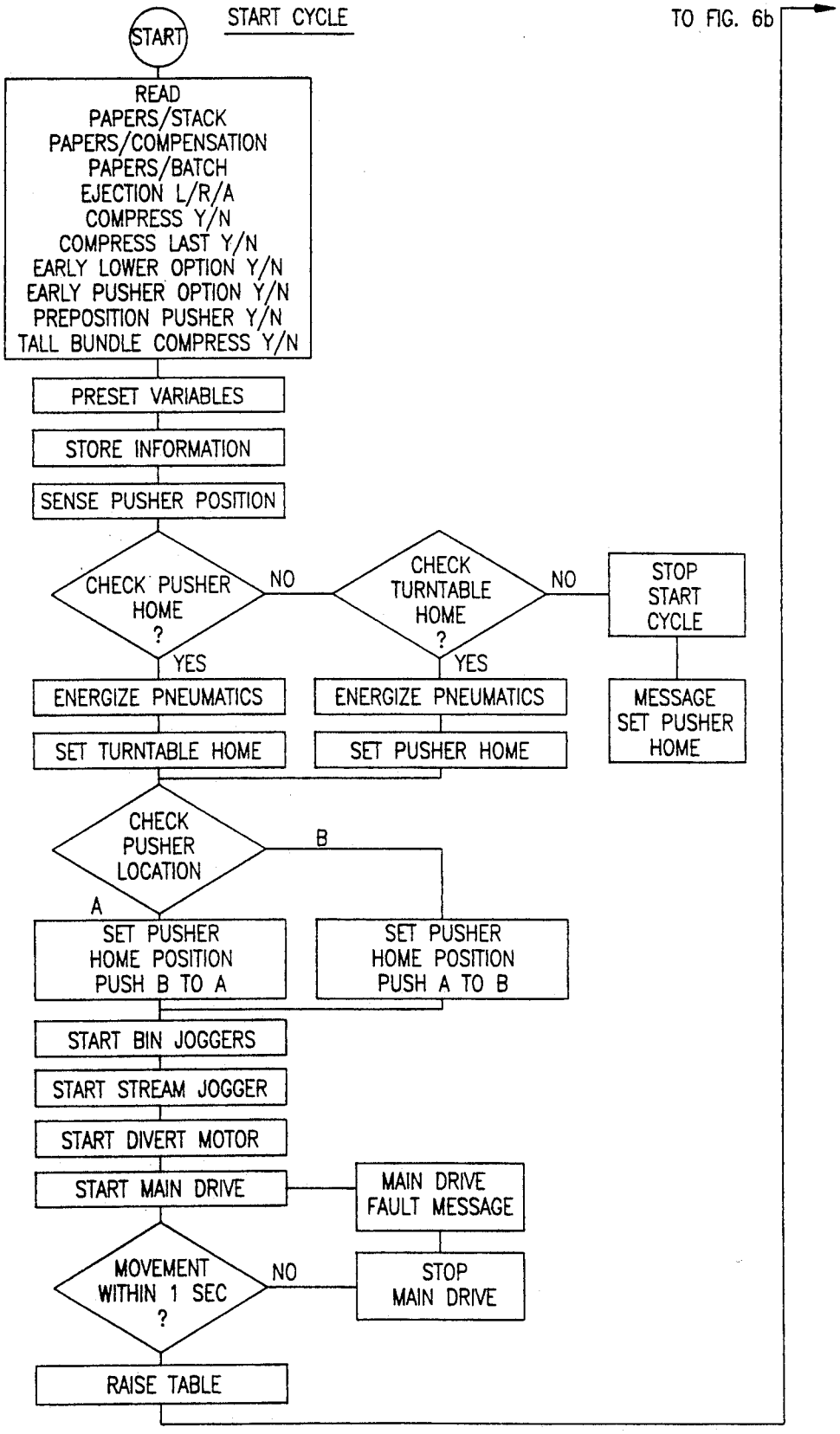
FIGS. 6*a*–6*f* are flow diagrams of the control system for the stacker of FIG. 1.
Figure 6B:
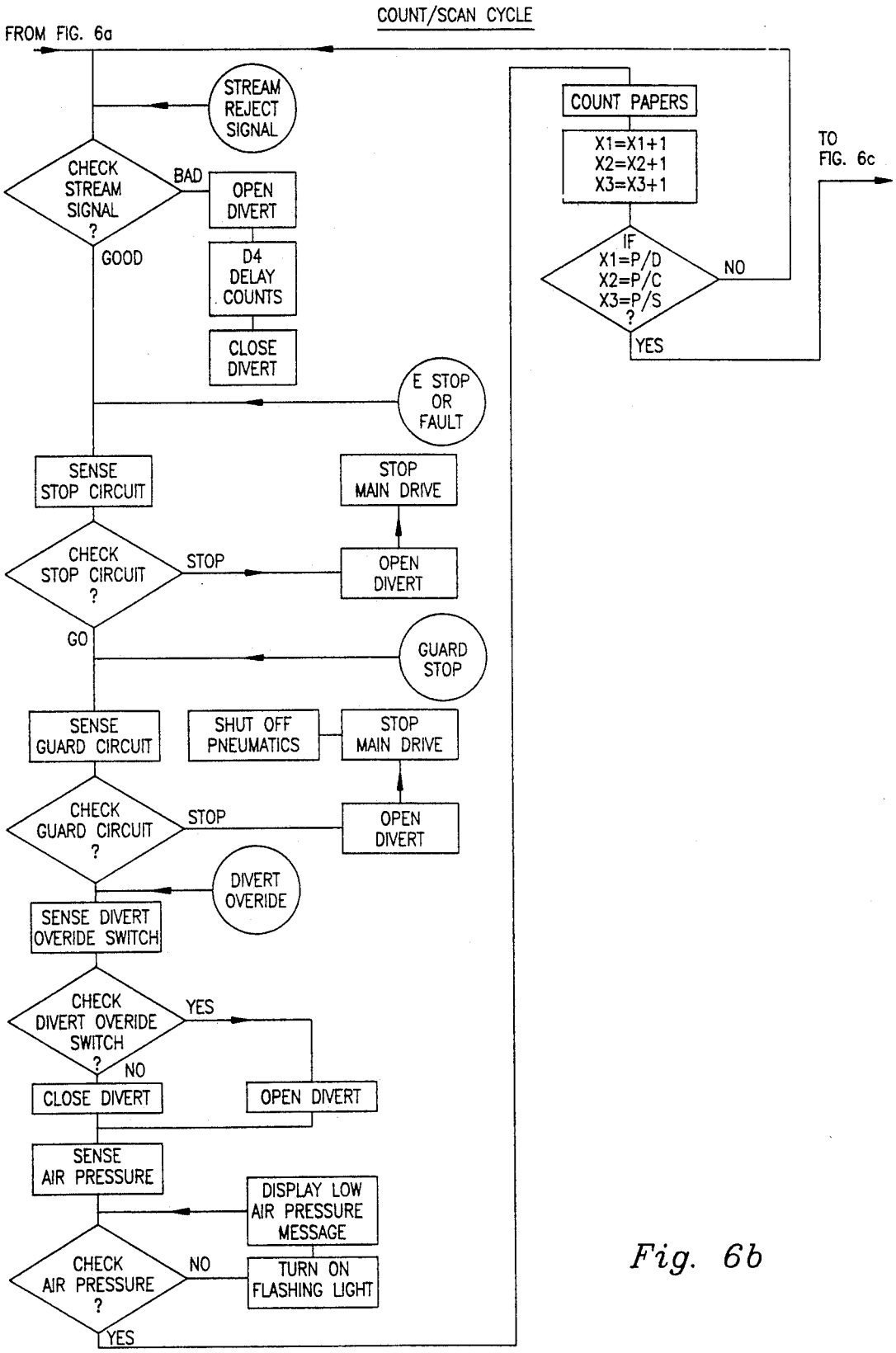
Figure 6C:
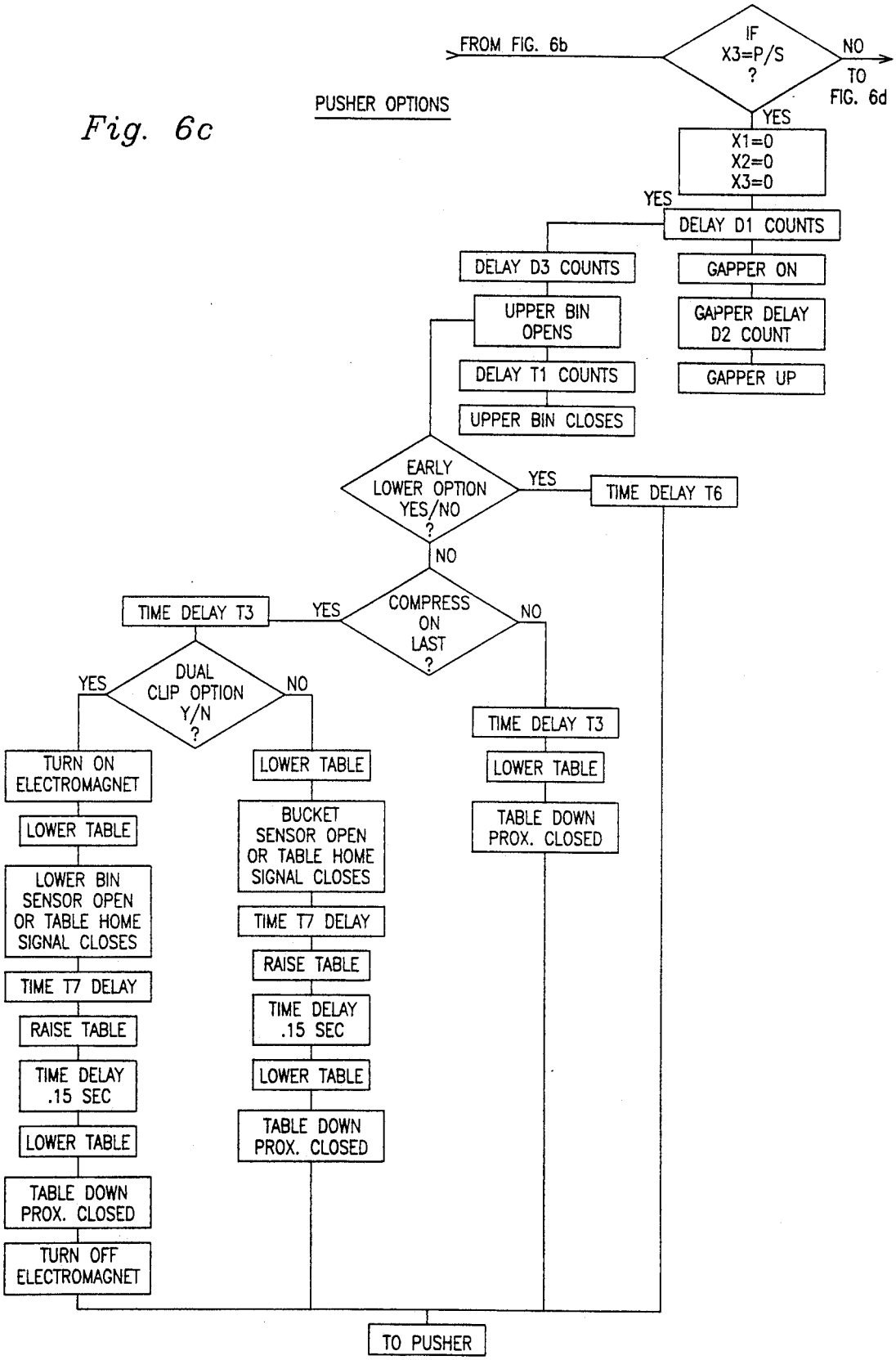
Figure 6D:
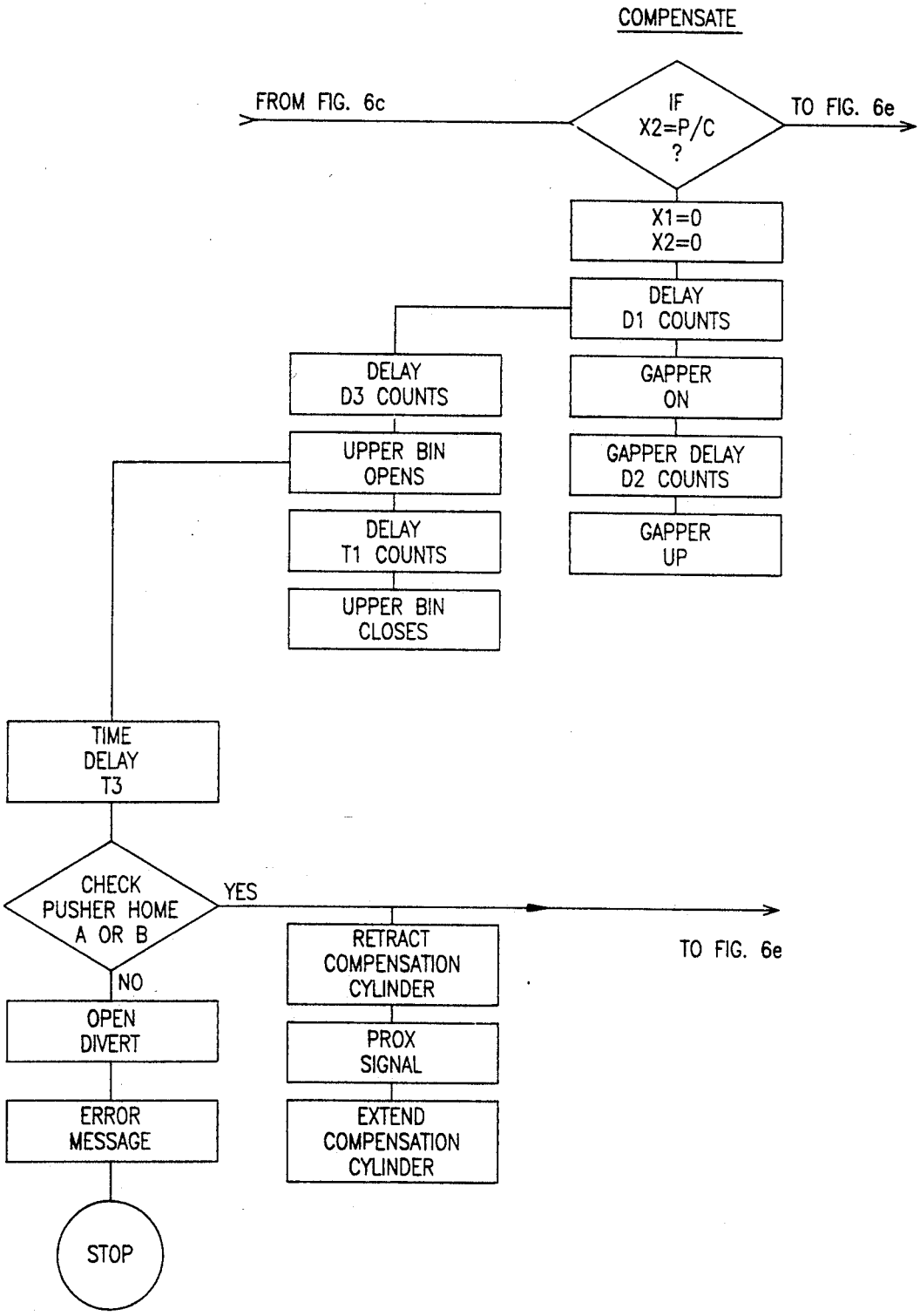
Figure 6E:
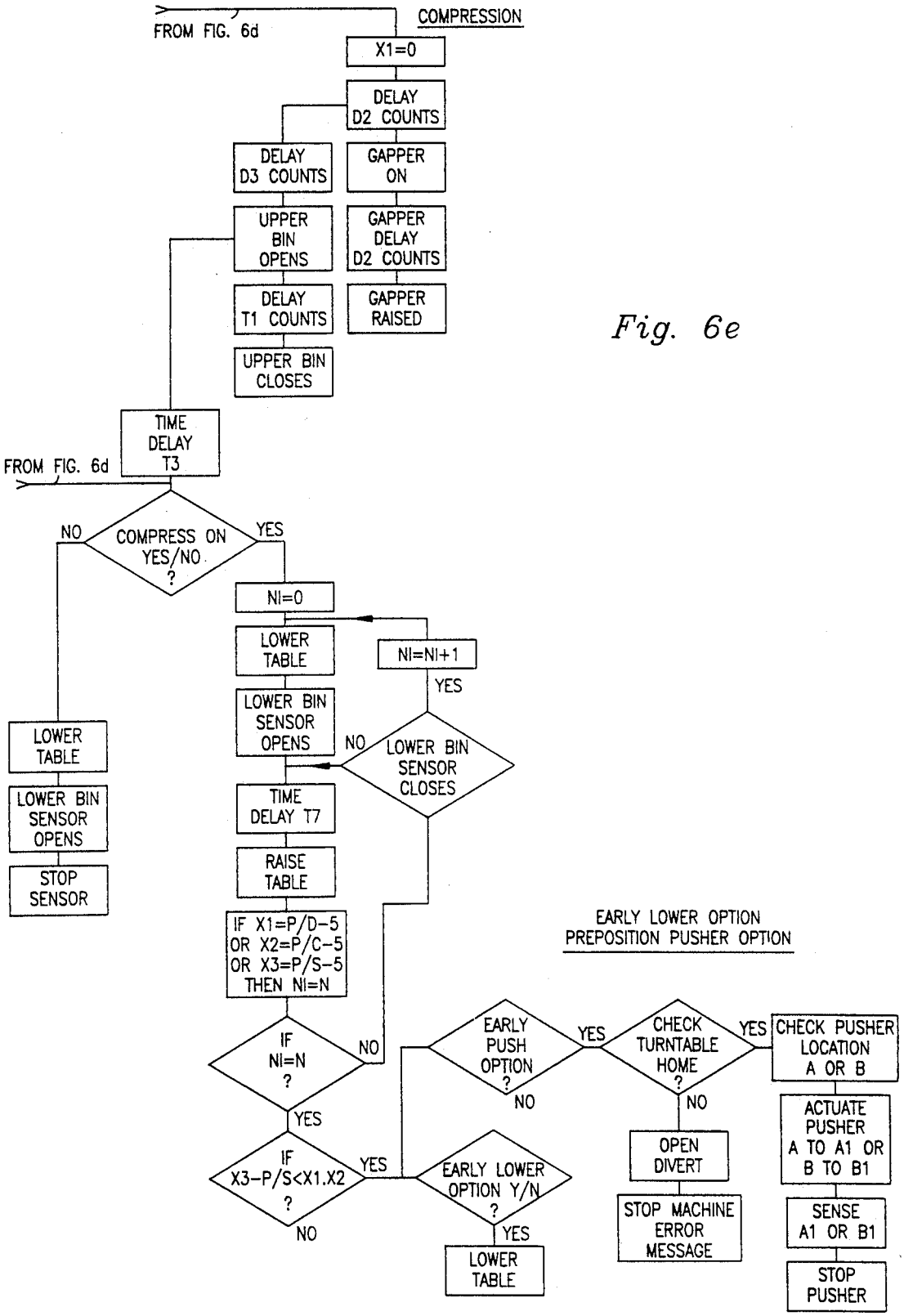
Figure 6F:
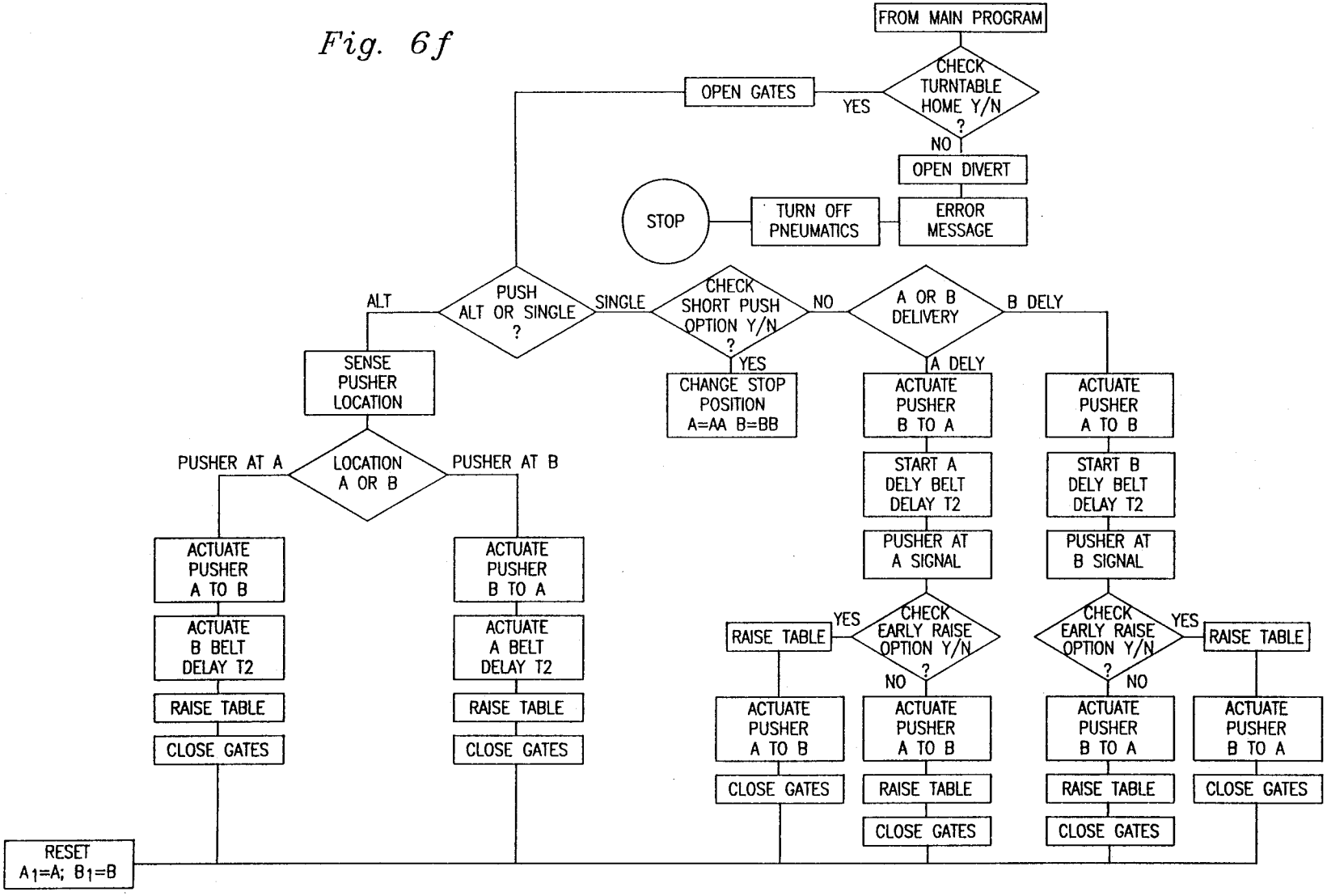
Figure 7:
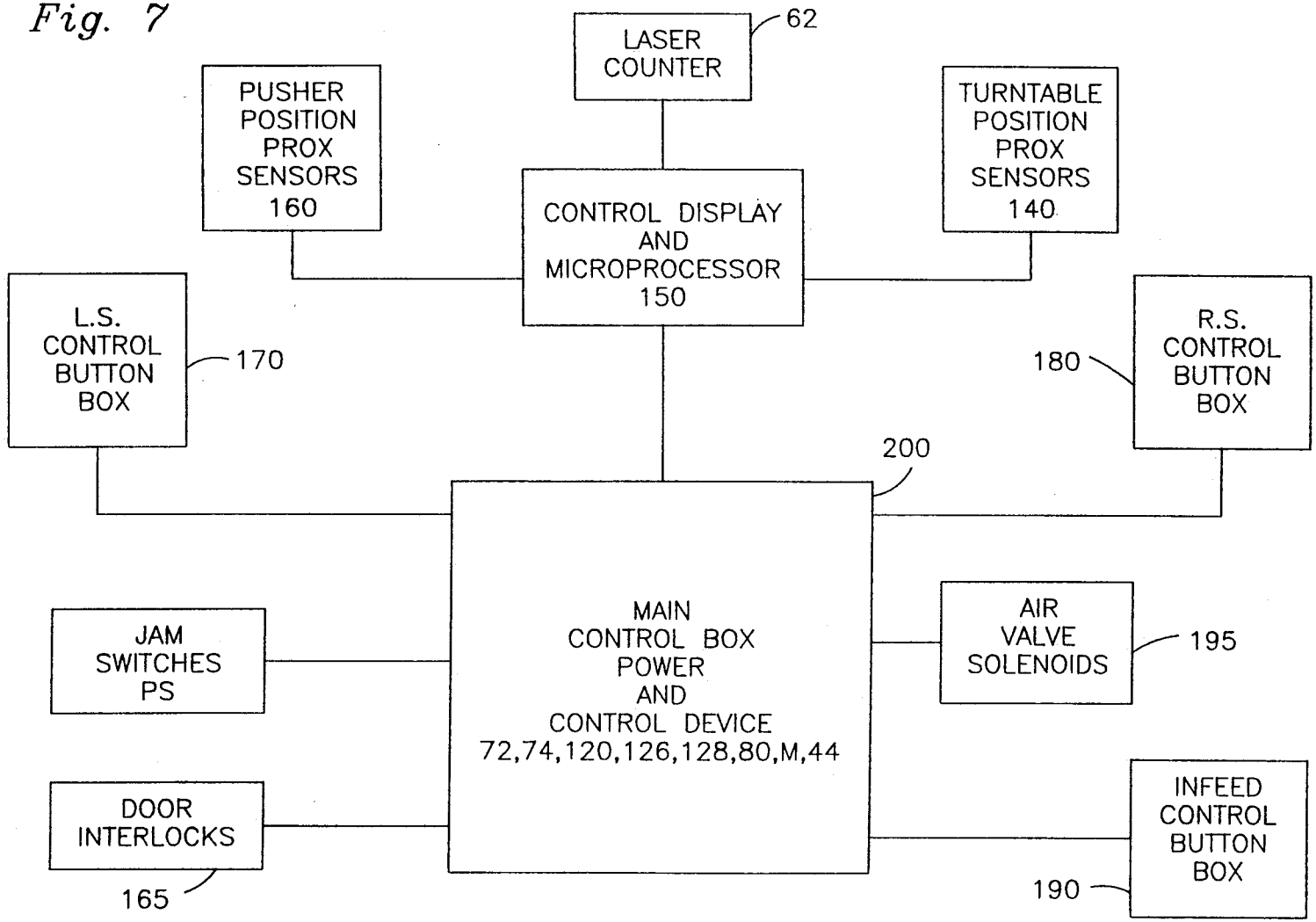
FIG. 7 is a block diagram of the control system for the stacker of FIG. 1.

FIG. 7 shows a simplified diagram of the system electronic controls. As was mentioned hereinabove, the stacker is controlled by a microprocessor which may, for example, be an electronic control system employed in the Model 200 Stacker manufactured by Quipp, Incorporated. The control system is preferably comprised of a microprocessor 150, which includes a display, a random access memory, and a read-only memory. Laser counter 62, pusher sensors 160, turntable sensors 140, jam switches PS, and door interlocks 165 are controlled by microprocessor 150. The left-side (L.S.) 170 and right-side (R.S.) 180 control button boxes are identical and allow the stacker to be run from either the left or right side and each have the same controls, including start/stop, run and clear controls. The main control box 200 includes the power source which powers the stacker and its components, the main motor 120, drive cylinders 72, 74, 126, 128, 136, pusher drive 80, side jogger motor M, belt jogger motor 44, all being controlled by the microprocessor. The infeed control box 190 controls the infeed section. The air valve solenoids 195 control the flow of pressure to the various cylinders. The system operating program is stored within the read-only memory and the flow diagram of the system is as shown in FIGS. 6*a*–6*f*. Considering FIG. 6*a*, upon start-up of the system, a plurality of variables are set such as the number of papers or signatures per stack, papers per compensation, papers per batch, type of ejection (left, right or alternate); the selection of certain operations, namely compression operation, compress on the last batch, early lower option, early raise option, prepositioning pusher, tall bundle compress, and early pusher return. All other variables are then preset, the information is stored and the pusher position is sensed. If the pusher 80 is in the home position, the pneumatics are energized and the turntable is set to the home position. If the pusher 80 is not in the home position, the position of the turntable is sensed (see sensor 140, FIG. 5). If the turntable is not in the home position, the stop cycle is terminated and the message "TAB-PUSH" is displayed. In the event that the turntable is in the home position, the pneumatics are energized and the pusher is moved to the home position with the aid of the appropriate sensor. The pusher position is again checked and, dependent upon the setting for either left or right ejection, the pusher is moved to the proper position.

The bin joggers 35, 37 and 44 and the stream joggers 16*a*, 16*a* in the stream aligner 16 are turned on, the diverter 14 motor is turned on and the main drive motor 120 is turned on. If no movement is detected within one second, by the small rotatable gear G on the shaft next to upper bin which cooperates with a proximity switch PS to generate a pulse for each ¾ inch, indicating a possible jam, the main drive is halted and a "main drive fault" message is displayed. Presuming the proper movement is detected, the turntable is raised to the stack receiving position just below the lower compression clips.

Presuming that the stream signal, provided by a suitable sensor in the infeed, indicates proper alignment of the stream (see FIG. 6*b*) the stop circuit is sensed. The stream sensors are aligned on opposite sides of the incoming stream upstream relative to the diverter. If the stream misalignment is greater than the capability of the stream aligned, this is detected by one or both of these sensors to activate the diverter. If the slop circuit is in the go condition, the guard circuit is sensed. If the guard circuit indicates that the safety guards 160 (provided as safety closing covers of the stacker, not shown for purposes of simplicity) are closed, the divert override switch is sensed and the diverter 14 is either opened or closed according to the condition of the divert override switch.

In the event that the stop circuit indicates a stop condition, the divert circuit is opened and main drive is halted.

In the event that the guard circuit indicates a stop condition, the diverter is opened, the main drive is halted, and the system pneumatics are deenergized.

Returning to the divert override switch operation, upon completion, the air pressure is sensed and in the event that the air pressure is insufficient, a flashing lamp is energized and a "low air pressure" message is displayed. Presuming the air pressure to be sufficient, the papers are counted by the non-contact counter 62. Each of the counts X1, X2, and X3 are incremented with the passage of each signature. If none of these counts reach a predetermined value, the count X1 being the number of papers per drop, the count X2 being the number of papers per compensate, and the count X3 being the number of papers per stack, the program branches back to the check stream signal. If any of these counts are reached, the program branches to an examination of the X3 count which is shown in FIG. 6*c*. If count X3 is equal to the count P/S, the values X1, X2 and X3 are set to zero and a delay D1 is initiated which is a count of the number of pulses developed by the infrared sensor utilized to count signatures. When the delay D1 has elapsed, the gapper is moved to the blocking position when turned on and a gapper delay D2 is initiated. This count is the delay period between the time that the gapper is operated to the signature blocking position until the time that the gapper is turned off, i.e. lifted. Upon reaching the D2 count, the gapper is moved up to allow for the passage of signatures held back by the gapper, which will form the next stack in the upper bin 34.

Upon initiation of the D1 count, a delay of a D3 count is initiated which is the period between the time that the gapper is turned off and the upper bin is opened to drop a stack into the lower bin. When the D3 count has elapsed, the upper bin is opened by operating the cylinders 126, 128 (FIG. 5). Thereafter, a T1 count is initiated which is a time delay between the time that the upper bin opens until it is ready to close. When the T1 count has elapsed, the upper bin is closed. At the time that the upper bin is opened, a determination is made of whether the early table lower option has been selected. This option is used when compression of the last stack forming the bundle is not critical. In the event that the early lower option has been selected, a time delay T6 which is the period between the opening of the upper bin and the operation of the table for early lower option, is initiated. When time delay T6 has elapsed, the program advances to the pusher subprogram shown in FIG. 6*f* which will be more fully described hereinbelow. Returning to the examination of the early lower option, in the event that the early lower option has not been chosen, the compress on last stack is examined. If no compression on the last stack has been selected, the program branches to generation of time delay T3 which is the time between the opening of the upper bin to the table lower compensate. Upon the completion of the elapsed time T3 the table of the lower bin is lowered and the table down proximite switch is closed when the table reaches the bundle eject position whereupon the program advances to the pusher subroutine shown in FIG. 6*f*. In the event that a compress on last batch has been selected, the time delay T3 is generated and if the stacker has upper and lower clip assemblies, the electromagnet is turned on to hold the lower clips open, the table is lowered, the bucket sensor is opened or the table home signal closes when the table reaches the eject position, and thereafter the time delay T7 is initiated which is the time a batch passes the sensor to the table raise. When the time T7 has elapsed, the table is raised and after a time delay of 0.15 seconds the table is again lowered. After the time delay of 0.15 seconds elapses, the table is lowered, and when the table down proximity switch is closed, the electromagnet is turned off, at which time the program advances to the pusher subroutine.

In the event that the stacker being employed does not have the dual clip option, the table is lowered, the bucket sensor is either open or the table home signal closes at which time the time delay T7 is initiated, the table is raised and is then lowered after a 0.15 second delay. When the table down proximity switch is closed, the program advances to the pusher subroutine.

Considering the pusher subroutine shown in FIG. 6*f*, the turntable is examined to determine if it is in the home position. In the event that the turntable is not in the home position, the diverter 14 is opened, an error message is displayed, the pneumatics are turned off, and the stacker is halted.

When the turntable is in the home position, the gates 84 (see FIGS. 1*a* and 2*b*, for example) are opened. In the event that signature bundles are to be diverted to alternating sides of the stacker, the pusher location is sensed. In the event that the pusher is located at position A, the pusher is actuated to move from A to B. The B belt of the take-off conveyor 82 (see FIG. 1*a*) is actuated after a delay period T2, the table is raised, the gates are closed and the pusher is reset.

When the pusher is at the B position, the pusher is actuated from position B to position A, the A belt of the take-off conveyor is actuated after a T2 delay, the table is raised, the gates are closed and the pusher is reset.

When bundles are to be pushed in only one direction, a check is made to determine whether the short push option has been selected. When the short push option has been selected, the stop position is changed to the location of one of the eject-ready sensors and the pusher is promptly reversed when it passes the selected eject-ready sensor thus reducing cycle time.

When the short push option is not selected, a determination is made of whether an A or B delivery is required. Since both of these deliveries are identical, only one will be described herein for purposes of simplicity.

Assuming an A delivery is required, the pusher is moved from B to A, and the A delivery belt is started after an elapsed delay time T2. When the pusher is at the A position, a signal is generated. If the early raise option has not been selected, the pusher is actuated to move from A back to B, the table is raised, the gates 84 are closed, and the pusher is reset. The return from A to B is performed through the use of the eject-ready sensor on the A side. As the pusher moves past this sensor, a reverse command (pusher at A signal) is given to start the turn-around before the pusher reaches the home position on the A side. The reverse operation is performed during an A to B delivery. If the early raise option has been selected, the table is raised, the pusher is actuated from A to B during the time that the table is being raised, and thereafter the gates are closed and the pusher is reset.

The compensate subroutine, shown in FIG. 6*d* is initiated by examining to determine if X2=P/C. If so, X1 and X2 are set to zero, a delay count D1 is initiated and a delay count D3 is initiated. Upon completion of the D1 delay, the gapper is turned on and after a D2 delay, the gapper is moved up to allow signatures temporarily restrained by the gapper to pass to the upper bin.

Upon completion of the D3 delay, the upper bin is opened and a time delay T3 is initiated. After the upper bin is opened, a T1 delay is initiated and the upper bin is closed when the T1 delay has elapsed.

When the T3 delay has elapsed, a check is made to determine whether the pusher is at either the A or B home position. If at neither, the diverter 14 is opened, an error message is displayed and the stacker is halted.

If the pusher is at one of the home positions A or B, the compensation cylinder 136 for rotating the turntable is retracted and upon generation of the proximity signal, i.e. when the turntable has rotated 90°, the compensation cylinder is extended. The retraction then extension sequence is the same for both clockwise and counterclockwise movement.

The compression routine, shown in FIG. 6*e*, is entered when X2=P/C at which time X1 is reset to zero and a delay count of D1 is initiated. When the D1 delay has expired, the gapper is turned on and after a D2 delay, the gapper is raised. Upon initiation of the D1 delay count, the D3 delay count is initiated. When the D3 count has elapsed, the upper bin is opened and is closed after a T1 delay count. Upon opening of the upper bin, if a compression operation has not been selected, the table is lowered, the lower bin sensor opens and when the sensor is stopped, if X3−P/S is less than X1 and X2, and if the early lower option has been selected, the table is lowered. If the early push option has been selected, a test is made to determine whether the turntable is home. If the turntable is not home, the diverter 14 is opened, an error message is displayed and the stacker is halted. If the turntable is home, a determination is made as to whether the pusher is either in the A or B position. In the A position, the pusher is moved to the A1 (eject-ready) position. If the pusher is in the B position, the pusher is moved to the B1 (eject-ready) position. The appropriate sensor determines whether the A1 or B1 position has been reached and the pusher is then stopped. This subroutine prepositions the pusher immediately adjacent one lateral side of the completed bundle as soon as the turntable has been rotated to a 180° angle and before the table has been lowered (i.e. during lowering), thus reducing the operating cycle.

In the event that the stacker is in the compress mode, N1 is set to zero and the table is lowered. When the lower bin sensor opens, the table is raised after a time delay T7. Counts X1, X2 and X3 are accumulated. If X1=P/D-5, or X2=P/C-5 or X3=P/S-5, then N1=N. If N1 is not equal to N, and the lower bin sensor has closed, N1 is increased by one and the steps from lowering the table down to testing for the value of N1 are repeated. If the lower bin sensor is not closed, the program advances to generation of the time delay T7.

When the count N1=N, the program branches to the step where the value of X3−P/S is determined to be either less than or greater than X1 and X2 at which time the program enters the early lower option or the preposition pusher option routines, described hereinabove.

As can be seen from the foregoing, the microprocessor-based controller of the stacker allows for a variety of options, for example, the turntable may be rotated after every stack is deposited thereon or after two or more stacks are deposited thereon. At the end of a pile, the stacker can drop the compensated bundle and push out or it can compress the last batch against the upper compression clips as well as selecting from between and among the other options described hereinabove.

The infrared sensor utilized to sense the leading edges of signatures generates the count delays D1-D4 described hereinabove. The upper bin is pulled out from beneath the batch being collected when the distance counter counts a given number of pulses from the proper count of signatures developed by the infrared sensors. As was mentioned hereinabove, the belts drive the signatures passing beneath the gapper to the upper bin to complete the proper count, the aforementioned delay being sufficient to allow the last signature passing beneath the gapper (which is now in the blocking position) to complete the stack. The completed stack falls from the upper bin downwardly into the lower bin by gravity when the reciprocating plates forming the floor of the upper bin are moved to the opened position.

The self-positioning clips of the present invention permit the performance of compression operations without the need for additional drive means and control means therefor. In addition, providing sets of both lower and upper clips permit compression upon bundle completion without sacrificing the important alignment functions performed by the lower bin supports.

The split platform and cooperating pusher permit prepositioning of the pusher during the time that the platform is being raised in readiness to receive and compress a subsequent signature stack. Prepositioning is also provided for movement of the pusher to positions immediately adjacent one lateral side of a completed bundle after the turntable has been rotated and preparatory to lowering of the turntable to its bottom position thus significantly reducing the system operating cycle. The eject-ready sensors also provide quick return of the pusher before the pusher reaches the opposite extreme (i.e. home) position.

It can thus be seen that the present invention provides a novel stacker for stacking and compressing signatures in order to form bundles which are neat and have a tight alignment tolerance. The stacker inlet end is adjustable to accommodate delivery conveyors within a wide height range. A diverter is capable of being activated to divert signatures away from the stacker to prevent a jaw and to prevent possible damage to the stacker. Signatures are guided by moving belts through a squeeze roll assembly to squeeze air out of the signatures and to compress the folded edges. The belts move the overlapping signature stream beneath an infrared sensor/counter and a gapper. When a predetermined count of signatures is developed, the gapper blocks the flow of further signatures downstream of the gapper. The counted signatures are delivered to an upper bin which serves as a "holding bin" providing a place for the product to accumulate while the "stack" which is in the lower bin (i.e. turntable) is being ejected or compensated. The number of products collected in the upper bin is a function of press speed and the amount of time required to eject or compensate a stack. For example, for a press running at 36,000 copies per hour (cph) and an ejection time of one second, the upper bin will collect ten products. At a delivery speed of 44,000 copies per hour, the bin will collect fifteen products during a one second interval.

If the ejection time were selected as 1.6 seconds, sixteen products will be collected at a delivery speed of 36,000 cph while twenty-four products will be collected at a delivery speed of 54,000 cph.

Given the number of products which will be delivered for a given cycle time, the upper bin is designed to be adjustable, in the preferred embodiment to provide a stacking height of five, six or seven inches. The height of a given stack is a function of thickness of the paper, the number of pages per product and the bulkiness of the product, i.e. the tightness of fold.

For example, given a cycle time of 1.6 seconds, a running speed of 72,000 cph and a ninety-six page tab, thirty-two products will be accumulated in the upper bin. For a sheet thickness of 0.0045 inches the upper bin has a capacity of twenty-four products when adjusted to provide an upper bin five inches deep. The upper bin depth may thus be adjusted to the seven inch depth to accommodate a product capacity of exactly thirty-two products.

The lower bin is principally comprised of a split turntable which is capable of being raised and lowered and of being rotated through a one-half turn.

Cycle times for the various modes for one preferred embodiment of the invention are as follows:

| FUNCTION* | CYCLE TIME (MINIMUM) | PARAMETER |
|---|---|---|
| Compensate | 1.0 sec. | |
| Eject Basic | 3.1 sec. | |
| Eject W/Pre-Positioned Pusher | 2.7 sec. | Improves Speed & Pile Quality |
| Eject W/Pre-Positioned Pusher And W/O Compression On Last Drop | 1.2 sec. to 1.6 sec. (Depends On Pile Height) | Last "Drop" From Upper Bin Not Compressed Some Loss Of Pile Quality |
| Eject W/Pre-Positioned Pusher And W/O Compression On Last Drop And W/Early Table Lower | 1.0 sec. | Adds To Distance Last "Drop" From Upper Bin Free Falls. May Create Discontinuity In Stack Where Last "Drop" Interfaces |
| Alternating Ejection W/Pre-Positioned Pusher And W/O Compression On Last Drop And W/Early Table Lower | 1.0 sec. | Piles Delivered Both Sides. May Help Stack Down |

*All for single side delivery except where noted.
*All modes utilizing early table rise which is a unique capability of the stacker.

A 2.7 second cycle time is generally more than adequate for the majority of applications.

The split turntable and prepositioning pusher are unique features which significantly decrease cycle time up to 1.3 seconds.

Another important feature which influences cycle time is the upper bin which is adjustable by the user in a substantially simple and straightforward manner.

The stacker of the present invention has the advantages of reducing manpower at the press delivery; eliminating or reducing the jogging of stacks; greater flexibility in stack make-up due to the selectability of compensates, odd counts and total counts; the reduced amount of space required for the stacker; the stacker is easily movable from one delivery station to another and is compatible to multiple press delivery configuration; is easily accessible for observation and maintenance; has a wide range of infeed interface height; is compatible to systems for downstream stack processing; counts stacks with a high degree of accuracy and has a design which is durable in construction and lends itself to easy maintenance. The operational capabilities of the preferred embodiment of the present invention are as follows:

| | |
|---|---|
| Operational Speed | Maximum 75,000 Copies Per Hour |
| Product Pages | Maximum - 96 Page (Tab) Minimum - 4 Page (Tab) (Capacity Of Stacker Measured In Terms Of Product Bulk And Speed) |
| Size | Width Max - 20 Inches Width Min - 5 Inches Length Max - 12¾ In. Length Min - 5¼ In. |
| Types Of Products | Tabloid, Half-Fold, Quarter-Fold, Double Parallel |
| Stream Lap | Maximum - 4 Inches Minimum - 2 Inches Uniformity And Consistency Of Lap Is Essential, Not Exceeding + Or −10% |

-continued

| | |
|---|---|
| | Of The Median Lap Distance |
| Capacity | Maximum - 300 In/Min. (Capacity Is A Measure Of The Vertical Volume Of Product Which Can Be Processed By The Stacker) |
| Product Orientation | Folded Edge Leading - Full Capabilities Of The Stacker<br>Folded Edge On Side - Approximately 60% Of Full Capabilities Of The Stacker<br>Folded Edge Trailing - Approximately 40% Of Full Capabilities Of The Stacker |
| Stack Make-Up | Single Side Delivery Equivalency:<br>Compensate Time: 1.0 Seconds<br>Ejection Time: 1.2 Seconds<br>Alternating Side Delivery Equivalency:<br>Compensate Time: 1.0 Seconds<br>Ejection Time: 1.0 Seconds<br>(Above Times May Require Elimination Table Elevation During The Ejection Cycle) |
| Upper Bin Capacity | Variable: 5", 6" Or 7" |
| Stack Height | Maximum - 16 Inches |
| Stack Delivery Height | 33½ to 35½ Inches |
| Infeed Height | Standard Model: 14 to 40 Inches<br>The Divert, Stream Aligner, Infeed And Squeeze Rolls May Be Eliminated When Used With Conventional Newspaper Stackers (At A Height Of 62.25") - 62.25 Inches |

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein described.

What is claimed is:

1. Apparatus for forming and delivering compressed stacks of signatures to an outfeed location comprising:

a rotatably mounted turntable for supporting signatures stacked thereon and movable between an upper stack receiving position and a lower bundle ejection position;

said turntable having a gap coinciding with and extending along a diameter of said turntable and dividing said turntable into a pair of turntable halves;

a pair of sidewalls positioned on opposite sides of said turntable for maintaining signatures stacked on said turntable in alignment;

means for rotating said turntable;

a pusher bar extending in a vertical direction movable along a linear path extending between two end points on opposite sides of said turntable;

the lower end of said pusher bar extending downwardly and through said turntable gap when said turntable gap is aligned with said linear path;

means for dropping a stack of signatures onto said turntable;

compression means movable into a position to engage the top signature when said signatures are supported on said turntable;

means for raising and lowering said turntable being operable to sequentially raise the turntable to compress the stack of signatures between said turntable and said compression means, lower the turntable to the bundle ejection position and raise the turntable to receive another stack of signatures;

means for moving said pusher bar being operable to move the pusher bar along said linear path in a first direction and a second direction to respectively push a compressed stack of signatures off of said turntable and onto an outfeed conveyor and to position the pusher bar to move the next stack of signatures to the outfeed location.

2. The apparatus of claim 1 further comprising:

a substantially U-shaped support for said turntable;

said U-shaped support comprising first and second arms each extending upwardly from a yoke portion;

said means for raising and lowering said turntable being coupled to said U-shaped support;

each of said pair of arms having an upper frame end;

each turntable half being respectively mounted upon the upper free end of a respective one of said first and second arms;

said pusher bar being movable between said turntable halves and said pair of arms.

3. The apparatus of claim 2 wherein:

said first and second arms each have a lower end;

the lower ends of said first and second arms are driven by the means for raising and lowering said turntable;

whereby said pusher bar may move freely through said gap and between said first and second arms to facilitate prepositioning of said pusher bar as the turntable is moved preparatory to receiving another stack of signatures.

4. The apparatus of claim 1 further comprising:

means for rotating said turntable through an angle of 180 degrees after receipt of a predetermined number of signatures stacks to form a compensated bundle.

5. The apparatus of claim 1 further comprising:

swingably mounted gates arranged at opposite ends of at least one of said side walls;

means for moving said gates between a closed position supporting opposite sides of a stack of signatures which are transverse to sides of the stack of signatures supported by said side walls and a second position away from said stack of signatures to facilitate pushing of the stack of signatures from said turntable onto an outfeed conveyor.

6. The apparatus of claim 1 wherein the pusher bar is sufficiently displaced from said turntable and supports when at either one of first and second end locations to permit rotation of the turntable without interference by said pusher bar;

said means for moving said pusher bar being operable to move the pusher bar from one of said end locations during lowering of the turntable to a position engaging the stack preparatory to pushing said stack off of the turntable.

7. A method for forming compressed bundles employing a turntable having turntable halves spaced apart to form a gap therebetween, a pair of supports on opposite sides of said turntable and movable compression members, and a pusher bar extending in a vertical direction and movable along a path through said gap so that the lower end of the pusher bar extends below said gap, comprising the steps of:

(a) raising the turntable halves to a given height to receive signatures to reduce the free fall distance of signatures delivered to the turntable;

(b) dropping a stack of signatures onto said turntable;

(c) lowering the turntable halves to enable the compression members to move to a position in a downward path of movement of signatures from a position above the turntable after a top end of the signature stack, supported by the turntable, is below the compression members;

(d) raising the turntable to compress the signature stack between the compression members and the turntable;

(e) lowering the turntable to a position wherein a support surface of said turntable is aligned with an outfeed means for receiving the compressed bundle;

(f) moving the pusher bar along its path of movement from an initial position displaced from the turntable and through said gap to push the compressed bundle onto said outfeed means;

(g) raising the turntable to a position for receiving the next stack of signatures;

(h) returning the pusher bar to its initial position as said turntable is being raised to preposition the pusher bar in readiness for another pushing operation.

8. The method of claim 7 further comprising the steps of:

rotating the turntable through 180 degrees before the turntable is lowered into alignment with the outfeed means; and moving the pusher bar to a position adjacent to one side of the compressed bundle to position the pusher bar in readiness to push a bundle off of said turntable.

9. A method for forming compressed bundles employing a turntable having turntable halves spaced apart to form a gap therebetween, a pair of supports on opposite sides of said turntable and movable compression members, and a pusher bar extending in a vertical direction and movable along a path extending through said gap so that the lower end thereof extends below said gap, comprising the steps of:

(a) raising the turntable to a given height to receive signatures to be stacked to reduce the free fall distance of signatures delivered to the turntable;

(b) dropping a stack of signatures onto said turntable;

(c) lowering the turntable to enable the compression members to move to a position in a downward path of movement of signatures from a position above the turntable after the top of the signature stack, supported by the turntable, is below the compression members;

(d) raising the turntable to compress the signature stack between the compression members and the turntable;

(e) rotating the turntable through an angle of 180 degrees;

(f) raising the turntable to a given position;

(g) dropping a second stack of signatures onto said turntable;

(h) repeating steps (c) and (d);

(i) lowering the turntable to a position wherein a support surface of said turntable is aligned with an outfeed means for receiving the compressed bundles;

(j) moving the pusher bar along its path of movement from an initial position and through said gap to push the compressed bundles onto said outfeed means, (k) raising the turntable to the position for receiving another stack of signatures;

(l) moving the pusher bar back through said gap and to its initial position as said turntable is being raised to preposition the pusher bar in readiness for another pushing operation.

10. Apparatus for forming and delivering stacks of signatures to an outfeed location comprising:

a rotatably mounted turntable;

a movable platform arranged on said turntable and having a pair of platform halves separated by a predetermined gap;

means for selectively moving said platform halves in a first direction to raise the platform halves for receiving a stack of signatures and for selectively moving said platform halves in a second direction to lower the signatures stacked thereon to an ejection position;

pusher means reciprocable along a path extending through said gap and between end positions located beyond opposing edges of said platform halves;

means for moving said pusher means from one end position to the other end position to push a stack of signatures off of said platform means; and said gap between said platform halves enabling said pusher means to be positioned within said gap when said platform halves are being raised or lowered and to permit said pusher means to be moved when said platform halves are being raised or lowered, without damaging said platform halves or said pusher means.

11. The apparatus of claim 10 further comprising means for rotating said turntable; and means responsive to movement of said pusher means to either one of a first and a second position displaced from the periphery of said platform halves to enable said turntable to be rotated.

12. The apparatus of claim 10 further comprising a pair of support means for guiding signatures deposited upon said platform halves.

13. The apparatus of claim 12 further comprising compression means selectively positionable to a compression position above said turntable to overlie a stack of signatures supported upon said platform halves; and said means for moving said platform halves being movable in said first direction to compress the stack of signatures supported on the platform halves between said platform halves and said compression means when in said compression position.

14. The apparatus of claim 12 wherein said pair of support means further comprises first and second spaced parallel support surfaces;

first and second end surfaces pivotally mounted upon the opposite ends of each of said first and second support surfaces and movable between a first position aligned transverse to said support surfaces to cooperate with said support surfaces for supporting signatures in a neat stack and a second position substantially aligned with the support surfaces to facilitate removal of a stack of signatures from said turntable.

15. The apparatus of claim 14 further comprising cylinder means for moving said end surfaces between said first and second positions.

16. The apparatus of claim 14 further comprising means for moving only the first and second end surfaces which are arranged at only one end of said first and second support surfaces when a stack of signatures is to be pushed off of said turntable.

17. The method of claim 14 wherein after step (c) the method further comprises the steps of:

positioning compression members above the turntable halves responsive to lowering of the turntable so that the top of the signature bundle in below a predetermined location; and raising the turntable halves to compress the signature bundle between the turntable halves and the compression members.

18. The apparatus of claim 10 further comprising means for rotating said turntable; and means responsive to rotation of said turntable to a position in which the gap is aligned with the path of movement of said pusher means to enable said pusher means to move along said path.

19. A method for forming bundles employing a turntable having movable turntable halves with supporting surfaces spaced apart to form a gap therebetween, a pair of supports on opposite sides of said turntable for guiding signatures delivered to said turntable, and a pusher bar extending in a vertical direction and movable along a path extending through said gap so that the lower end thereof extends below the supporting surfaces of the turntable halves, said method comprising the steps of:

(a) raising the turntable halves to a given height to receive signatures;

(b) dropping a stack of signatures from a delivery location above the turntable downwardly onto said turntable, the stack of signatures being aligned so as to move between said supports with the bottom signature falling on said supporting surfaces;

(c) lowering the turntable halves to receive the next stack of signatures;

(d) dropping another stack of signatures from said delivery location upon the previously dropped stack of signatures;

(e) moving the pusher bar along its path of movement from an initial position to push the bundle of signatures on said turntable halves to an outfeed location;

(f) raising the turntable preparatory to receiving a new stack of signatures; and (g) moving the pusher bar along its path of movement as said turntable is being raised whereby said gap prevents the pusher bar from engaging the turntable halves.

20. Apparatus for forming compensated signatures bundles comprising:

a platform for receiving signatures;

supports arranged on opposite sides of said platform for aligning signatures delivered to the platform;

means for selectively delivering stacks each having a plurality of signatures including means for dropping each stack into the region between said supports and upon said platform;

means for rotating said platform through one-half revolution after receiving each stack to form a compensated bundle;

pusher means comprising a bar movable along a linear path which is arranged between said supports and is parallel to said supports;

means for moving said pusher means to eject a compensated bundle from said platform, said moving means moving said pusher means to a home position sufficiently displaced from said platform to permit said platform to rotate free from any interference with said pusher means while forming a compensated bundle, said means for moving said pusher means moving the pusher means from the home position to an eject-ready position closer to the platform than the home position and immediately adjacent one side of a bundle being formed to thereby preposition said pusher means in readiness for ejection of a bundle after a final stack has been dropped onto said platform by said means for selectively delivering.

21. The apparatus of claim 20 further comprising:

means for selectively raising and lowering said platform between a lower eject position and an upper stack receiving position;

said means for moving said pusher means initiating movement of said pusher means from the home position to the eject-ready position prior to a lowering of the platform to the eject position.

22. The apparatus of claim 21 wherein:

said platform is raised by said means for selectively raising and lowering after ejection of a bundle; and said pusher means is moved to said home position by said means for moving said pusher means after ejecting a bundle and while said platform is being raised by said means for selectively raising and lowering.

23. The apparatus of claim 20 further comprising:

compression means arranged above said platform;

said means for selectively raising and lowering said platform raising said platform to compress signatures between the platform and said compression means;

said pusher means being moved by said means for moving from said home position to said eject-ready position during a time when said platform is lowering a compensated bundle toward the eject position.

24. The apparatus of claim 20 wherein said pusher means is movable along said linear path between first and second home positions each displaced from the platform sufficient to permit interference-free rotation of the platform when the pusher means is at either of said first and second home positions;

said pusher means being respectively movable from said first and second home positions to an associated first and second eject-ready position adjacent an associated side of a bundle to be ejected;

sensor means being provided at each home and eject-ready position for sensing said pusher means; and means for halting movement of said pusher means responsive to detection of said pusher means by said sensor means when the pusher means is position at an eject-ready position.

25. The apparatus of claim 24 further comprising:

means for controlling the pusher means to eject bundles to only one side of the platform;

means responsive to detection of the pusher means by the sensor means provided at the eject-ready position on the side of the platform from which the bundle is ejected for returning the pusher means to the home position originally occupied by the pusher means preparatory to the ejection operation.

26. The apparatus of claim 25 further comprising:

means for halting the pusher means responsive to detection of the pusher means by the sensor means located at each home position.

27. The apparatus of claim 20 wherein said pusher means is movable between first and second home positions each being sufficiently displaced from a region of movement of said platform to permit rotation of said platform without interference; and said means for moving said pusher means moving said pusher means to a selected one of said first and second home positions preparatory to a bundle forming operation and preparatory to movement of said pusher means from the selected home position to an eject-ready position associated with the selected home position.

28. The apparatus of claim 20 further comprising:

means responsive to one of said sensor means for returning the pusher means to a selected one of said first and second home positions after ejecting a bundle from the platform.

29. The apparatus of claim 28 further comprising:

means for selectively raising said platform, and means for initiating operation of said platform raising means during return of said pusher means to a selected one of said first and second home positions.

30. The apparatus of claim 20 wherein said pusher means is movable between first and second home positions on opposing sides of said platform which home positions are sufficiently displaced from said platform to allow rotation of said platform without interference; and said means for moving said pusher means to eject bundles further comprising means for moving said pusher means in alternating directions along said linear path after the completion of each bundle to eject bundles on alternating sides of said platform.

31. The apparatus of claim 20 wherein said platform is movable between an upper and a lower position and is comprised of platform halves defining a gap therebetween; said pusher means being movable through said gap when said gap is aligned with said linear path and said platform is moving upwardly from the lower position after ejection of a bundle.

* * * * *

UNITED STATES PATENT AND TRADEMARK OFFICE

CERTIFICATE OF CORRECTION

PATENT NO. : 5,282,716

DATED : February 1, 1994

INVENTOR(S) : John Prim and David Hall

It is certified that error appears in the above-indentified patent and that said Letters Patent is hereby corrected as shown below:

Column 1, line 6 change "abandoned" to --Patent No. 5,092,236--.

Column 4, line 38 change "With" to --with--.

Column 4, line 40 change "also" to --(also--.

Column 13, line 16 delete "1".

Column 13, line 35 delete ":".

Column 15, line 22 change "3/4" to --1/3--.

Column 15, line 35 change "slop" to --stop--.

Column 16, line 36 change "proximite" to --proximity--.

Column 19, line 21 change "jaw" to --jam--

UNITED STATES PATENT AND TRADEMARK OFFICE

CERTIFICATE OF CORRECTION

PATENT NO. : 5,282,716

DATED : February 1, 1994

INVENTOR(S) : John Prim and David Hall

It is certified that error appears in the above-indentified patent and that said Letters Patent is hereby corrected as shown below:

Claim 2, column 22, line 29 change "frame" to --free--.

Claim 4, column 22, line 49 change "signatures" to --signature--.

Claim 20, column 25, line 64 change "signatures" to --signature--.

Claim 24, column 26, line 68 change "tion" to --tioned--.

Signed and Sealed this

Fourth Day of October, 1994

*Attest:*

*Attesting Officer*

Bruce Lehman

BRUCE LEHMAN

*Commissioner of Patents and Trademarks*